US010196746B2

(12) United States Patent
Leonard et al.

(10) Patent No.: US 10,196,746 B2
(45) Date of Patent: Feb. 5, 2019

(54) MICROWAVE ASSISTED SYNTHESIS OF METAL OXYHYDROXIDES

(71) Applicant: University of Kansas, Lawrence, KS (US)

(72) Inventors: Kevin C. Leonard, Lawrence, KS (US); Joseph M. Barforoush, Lawrence, KS (US); Tess E. Seuferling, Lawrence, KS (US); Kelly R. Song, Lawrence, KS (US)

(73) Assignee: UNIVERSITY OF KANSAS, Lawrence, KS (US)

( * ) Notice: Subject to any disclaimer, the term of this patent is extended or adjusted under 35 U.S.C. 154(b) by 0 days.

(21) Appl. No.: 15/581,387

(22) Filed: Apr. 28, 2017

(65) Prior Publication Data

US 2017/0314142 A1 Nov. 2, 2017

Related U.S. Application Data

(60) Provisional application No. 62/471,097, filed on Mar. 14, 2017, provisional application No. 62/444,677, filed on Jan. 10, 2017, provisional application No. 62/329,333, filed on Apr. 29, 2016.

(51) Int. Cl.

| | |
|---|---|
| ***C25B 1/00*** | (2006.01) |
| ***B01J 37/03*** | (2006.01) |
| ***B01J 37/34*** | (2006.01) |
| ***B01J 23/00*** | (2006.01) |

(52) U.S. Cl.
CPC ..... *C25B 1/003* (2013.01)

(58) Field of Classification Search
CPC ..... C25B 1/003; B01L 37/035; B01L 37/346; B01J 23/00
See application file for complete search history.

(56) References Cited

U.S. PATENT DOCUMENTS

2010/0320155 A1* 12/2010 Enos ..... C02F 1/5236 210/717

OTHER PUBLICATIONS

Smith et al., Water Oxidation Catalysis: Electrocatalytic Response to Metal Stoichiometry in Amorphous Metal Oxide Films Containing Iron, Cobalt, and Nickel, J. Am. Chem. Soc., 135, Jul. 24, 2013, pp. 11580-11586.

(Continued)

*Primary Examiner* — Cam N. Nguyen
(74) *Attorney, Agent, or Firm* — Bell & Manning, LLC

(57) ABSTRACT

A method for making a metal oxyhydroxide electrocatalytic material comprises titrating a precursor solution with a (bi)carbonate salt, the precursor solution comprising a first metal salt and a solvent, wherein the titration induces reactions between the (bi)carbonate salt and the first metal salt to provide first metal carbonate species in the titrated precursor solution; and exposing the titrated precursor solution to microwave radiation to decompose the first metal carbonate species to form the metal oxyhydroxide electrocatalytic material and carbon dioxide. Mixed metal oxyhydroxide electrocatalytic materials such as nickel-iron oxyhydroxide may be formed. Also provided are the materials themselves, electrocatalytic systems comprising the materials, and methods of using the materials and systems.

15 Claims, 24 Drawing Sheets

(56) References Cited

OTHER PUBLICATIONS

Wang et al., Facile synthesis of Fe/Ni bimetallic oxide solid-solution nanoparticles with superior electrocatalytic activity for oxygen evolution reaction, Nano Research 8(12), Oct. 10, 2015, pp. 3815-3822.
Smith et al., Photochemical Route for Accessing Amorphous Metal Oxide Materials for Water Oxidation Catalysis, Science, vol. 340, Mar. 28, 2013, pp. 60-63.
Zhang et al., Homogeneously dispersed multimetal oxygen-evolving catalysts, Science, vol. 352, Mar. 24, 2016, pp. 333-337.
Katsuki et al., Microwave-Hydrothermal Synthesis of Monodispersed Nanophase $\alpha$-$Fe_2O_3$, J. Am. Ceram. Soc., 84 (10), Oct. 2001, pp. 2313-2317.
Gorlin et al., Dynamical changes of a Ni—Fe oxide water splitting catalystinvestigated at different pH, Catalysis Today 262, Nov. 24, 2015, pp. 65-73.

* cited by examiner

10 µm

1 µm

10 µm

1 µm

50 µm

1 µm
Crystal-Derived
Microwave
Non-Microwave 100 nm 20 nm 10 nm 5 nm

MICROWAVE ASSISTED SYNTHESIS OF METAL OXYHYDROXIDES

CROSS-REFERENCE TO RELATED APPLICATIONS

The present application claims priority to U.S. Provisional Patent Application No. 62/329,333 that was filed Apr. 29, 2016, to U.S. Provisional Patent Application No. 62/444,677 that was filed Jan. 10, 2017, and to U.S. Provisional Patent Application No. 62/471,097 that was filed Mar. 14, 2017, the entire disclosures of which are hereby incorporated by reference.

BACKGROUND

The development of efficient, earth-abundant electrocatalysts for the oxygen evolution reaction (OER) is of great importance to solar fuel production, because the OER is the half reaction that limits the overall efficency.[1-3] Developing catalysts for the OER is especially challenging because the oxidation of water to oxygen occurs through a complex four-electron/four-proton transfer[4] and many materials require a significant overpotential to drive the catalysis.[5] Traditionally, the best catalysts for the OER have been composed of the noble metals Ru and Ir.[6-8] However, since the discovery that iron impurities can improve the OER activity of nickel oxide electrocatalysts,[9,10] nickel-iron oxyhydroxides ($Ni_{1-x}Fe_xOOH$), specifically the layered double hydroxide (LDH) structure of $Ni_{1-x}Fe_xOOH$, have emerged as promising non-precious metal OER electrocatalysts in alkaline media and can rival the performance of iridium oxides.[11-30]

SUMMARY

Provided are methods for making metal oxyhydroxide electrocatalytic materials. Also provided are the materials themselves, electrocatalytic systems comprising the materials, and methods of using the materials and systems.

In one embodiment, a method for making a metal oxyhydroxide electrocatalytic material comprises titrating a precursor solution with a (bi)carbonate salt, the precursor solution comprising a first metal salt and a solvent, wherein the titration induces reactions between the (bi)carbonate salt and the first metal salt to provide first metal carbonate species in the titrated precursor solution; and exposing the titrated precursor solution to microwave radiation to decompose the first metal carbonate species to form the metal oxyhydroxide electrocatalytic material and carbon dioxide.

In one embodiment, a metal oxyhydroxide electrocatalytic material has a morphology characterized as a substantially continuous matrix having irregularly shaped pores distributed throughout the matrix as determined by scanning electron microscopy. The material is also nanoamorphous as determined by high resolution transmission electron microscopy electron diffraction patterns exhibiting a lack of selected area electron diffraction spots at about a 5 nm spatial resolution. The material is also characterized by a homogeneous distribution of metal atoms throughout the material as exhibited by oxygen (O) 1s X-ray photoelectron spectroscopy spectra having no more than a single peak.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

Please refer to the definitions in the "Examples" section below for the terms "microwave-assisted", "solution-derived", "crystal-derived", and the like.

DETAILED DESCRIPTION

Figures 1A, 1B, 1C, 1D, 1E, 1F:
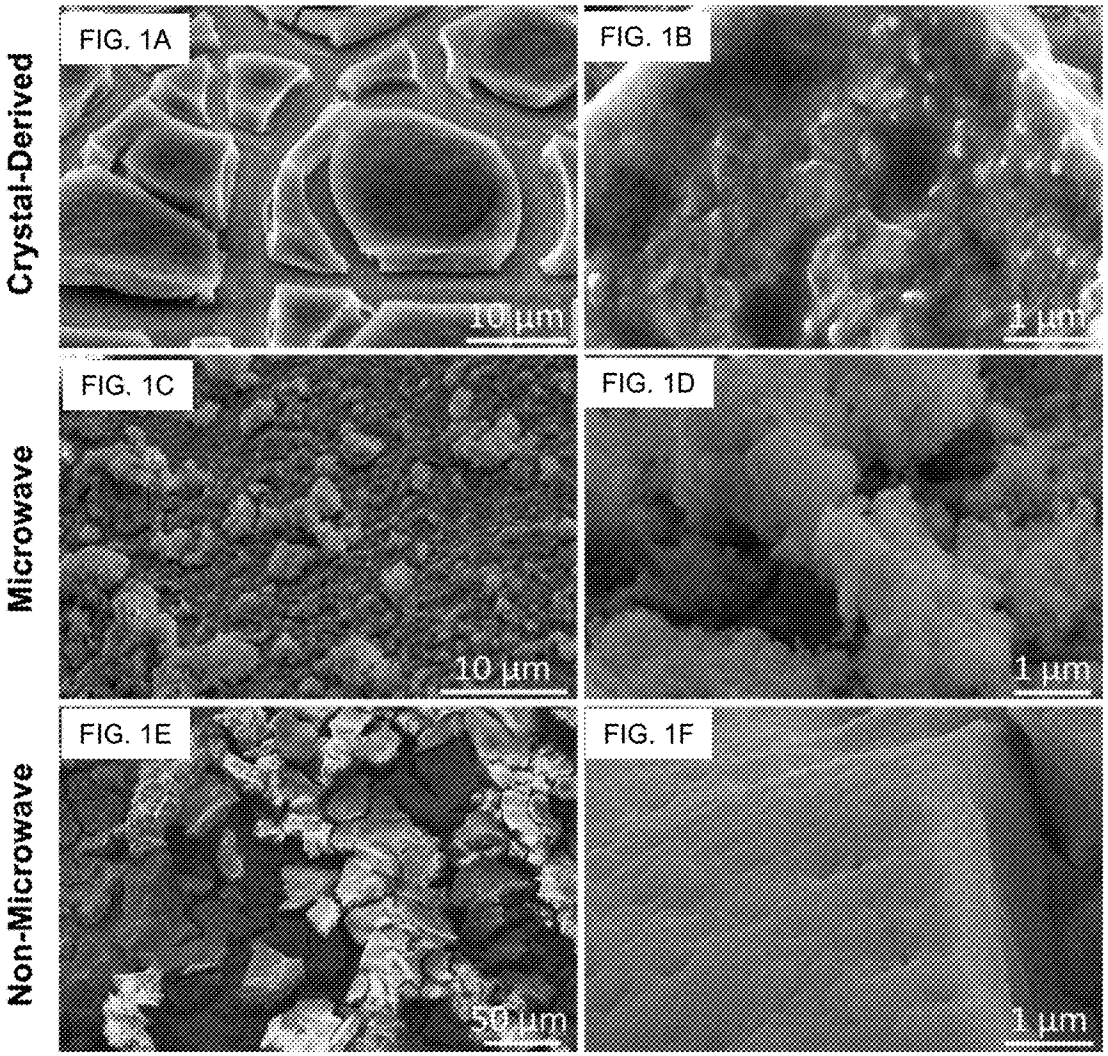
FIG. 1A-1F show scanning electron microscopy (SEM) images of crystal-derived (FIGS. 1A, 1B), microwave-assisted (FIGS. 1C, 1D), and solution-derived (non-microwaved) (FIGS. 1E, 1F), $Ni_{0.8}$:$Fe_{0.2}$ catalysts deposited on FTO-coated glass.

Provided are methods for making metal oxyhydroxide electrocatalytic materials, including mixed metal oxyhydroxide electrocatalytic materials such as nickel-iron oxyhydroxide. Also provided are the materials themselves, electrocatalytic systems comprising the materials, and methods of using the materials and systems.

The invention is based, at least in part, on the inventors' discovery of a method for providing metal oxyhydroxide electrocatalytic materials having unique physical properties (relating to their morphology, lack of crystallinity, and homogeneity of metal atoms) and thus, superior catalytic performance. This is compared to metal oxyhydroxide electrocatalytic materials formed using conventional methods, including electrochemical conditioning of crystalline metal oxides. Because of the unique method used to provide the materials, the disclosed metal oxyhydroxide electrocatalytic materials may be structurally distinguished from conventional metal oxyhydroxides labeled as being "amorphous" and/or "homogeneous." This is further described below. Moreover, the disclosed methods involve mild conditions and readily available materials, thereby facilitating the practical use of the metal oxyhydroxide electrocatalytic materials for catalyzing certain electrochemical reactions, including the oxygen evolution reaction (OER) as well as the hydrogen evolution reaction (HER).

Methods of making metal oxyhydroxide electrocatalytic materials are provided. For reference, an illustrative embodiment of the method is shown in the left schematic of FIG. 7. As an initial step, the method may include forming a precursor solution including a first metal precursor compound and a solvent. More than one type of metal precursor compound may be used. The use of two different metal precursor compounds results in a binary metal oxyhydroxide; the use of three different metal precursor compounds results in a ternary metal oxyhydroxide. However, even more metal precursor compounds may be used, e.g., four, five, etc. The metal of the metal precursor compounds is not particularly limited. In embodiments, the metal is a transition metal. Various transition metals may be used, including 3d transition metals such as iron (Fe), cobalt (Co) and nickel (Ni). However, other transition metals may be used, e.g., tungsten (W). Other metals such as post-transition metals and metalloids in Groups 13-16 may also be used. These include, by way of illustration, In, Sb, Pb and Bi.

A variety of metal precursor compounds may be used, including metal salts such as metal nitrates, nitrites, sulfates, sulfites, sulfamates, phosphates, phosphites, fluorides, chlorides, bromides, iododides, perchlorates, carbonates, hydroxides, oxalates, molybdates, paratungstates, metatungstates, and citrates, etc. in their hydrous or anhydrous forms. These types of metal salts can dissolve in the appropriate solvent to form metal cations and associated anions in the precursor solution.

Different relative amounts (e.g., molar ratios) of the metal precursor compounds may be used in the precursor solution, depending upon the desired ratio of metals in the oxyhydroxide electrocatalytic material. By way of illustration, a binary metal oxyhydroxide electrocatalytic material may be referred to as a "$M'_{(1-x)}$:$M''_x$ oxyhydroxide electrocatalytic material," wherein M' and M" are different metals. The relative amount may be selected to maximize the catalytic performance of the mixed metal oxyhydroxide electrocatalytic material. In embodiments, x is in the range from greater than 0 to about 1. This includes embodiments in which x is in the range from about 0.1 to about 1, or from about 0.1 to about 0.5. In another embodiment, the metal precursor compounds are nickel and iron precursor compounds and the molar ratio of nickel:iron in the precursor solution is about 8:2 to provide a $Ni_{0.8}$:$Fe_{0.2}$ oxyhydroxide electrocatalytic material (although the relative amounts of Ni and Fe may deviate slightly from these values, e.g., by ±10%, ±5%, ±2%). In another embodiment, the metal precursor compounds are nickel and cobalt precursor compounds and the molar ratio of nickel:cobalt in the precursor solution is about 1:1 to provide a Ni:Co oxyhydroxide electrocatalytic material (although the relative amounts of Ni and Co may deviate slightly from these values as described above).

Similarly, a ternary metal oxyhydroxide electrocatalytic material may be referred to as a "$M'_x$:$M''_y$;$M'''_z$ oxyhydroxide electrocatalytic material," wherein M', M", and M"' are different metals. Again, the relative amount may be selected to maximize the catalytic performance of the mixed metal oxyhydroxide electrocatalytic material and x, y, and z may independently range from greater than 0 to about 1. In one embodiment, the metal precursor compounds are tungsten, iron, and cobalt precursor compounds and the molar ratio of tungsten:iron:cobalt in the precursor solution is about 1:1:1 to provide a W:Fe:Co oxyhydroxide electrocatalytic material (although the relative amounts of W, Fe and Co may deviate slightly from these values as described above). In another embodiment, the metal precursor compounds are nickel, iron, and cobalt precursor compounds and the molar ratio of nickel:iron:cobalt in the precursor solution is about 1:1:1 to provide a Ni:Fe:Co oxyhydroxide electrocatalytic material (although the relative amounts of Ni, Fe and Co may deviate slightly from these values as described above).

The solvent may be selected to dissolve the metal precursor compounds in order to form a solution. Illustrative solvents include water, and a variety of organic solvents. In embodiments, the solvent is water and the metal precursor solution is substantially free of organic solvent(s). By "substantially" it is meant that the amount of organic solvent(s) is zero, not measurable, or so small so as to not affect the titration and decomposition reactions which take place in the precursor solution as described below.

The disclosed methods involve titrating the precursor solution with a gelling agent. The gelling agent may be added as a solution, e.g., an aqueous solution. In the titration, the gelling agent is added to the precursor solution at a controlled rate and for a period of time in order to facilitate certain reactions between the metal precursor compound(s) and the gelling agent, as further described below. An illustrative gelling agent is a salt compound such as a carbonate salt of an alkali metal or an alkaline earth metal or a bicarbonate salt of an alkali metal or an alkaline earth metal. The term "(bi)carbonate" as used throughout the present disclosure encompasses both carbonate and bicarbonate. Sodium bicarbonate ($NaHCO_3$) is an illustrative example. Like the metal salts described above, (bi)carbonate salts can dissolve in the appropriate solvent (i.e., the solvent of the precursor solution) to form cations and (bi)carbonate anions. In the titration, metal cations from the metal precursor compound(s) react with the (bi)carbonate anions from the gelling agent to form a metal carbonate species accompanied by the release of carbon dioxide.

By way of illustration, the relevant titration reactions are shown in Equations 1 and 2, below, for the reaction of iron cations ($Fe^{3+}$) from an iron precursor compound with bicarbonate anions ($HCO_3^-$) from sodium bicarbonate. In Equation 1, $Fe^{3+}$ cations react with $HCO_3^-$ anions to form iron (III) bicarbonate ($Fe(HCO_3)_3$). In Equation 2, $Fe(HCO_3)_3$ spontaneously decomposes to iron (III) carbonate ($Fe_2(CO_3)_3$) and releases carbon dioxide. The subsequent decomposition of the metal carbonate species (e.g., $Fe_2(CO_3)_3$) to form the metal oxyhydroxide and additional carbon dioxide is further described below (see also Equation 3, below). If there are additional metal precursor compounds in the precursor solution, additional metal carbonate species will also be formed via analogous reactions.

$$Fe^{3+}+3HCO_3^- \rightarrow Fe(HCO_3)_3 \quad \text{(Equation 1)}$$

$$2Fe(HCO_3)_3 \rightarrow Fe_2(CO_3)_3+3CO_2+3H_2O \quad \text{(Equation 2)}$$

$$Fe_2(CO_3)_3 \rightarrow \text{iron oxides}+3CO_2 \quad \text{(Equation 3)}$$

The controlled rate of addition of the gelling agent and the period of time may be selected to facilitate the titration reactions illustrated by Equations 1 and 2, that is, the reaction of metal cations from the metal precursor compound(s) with (bi)carbonate anions from the gelling agent to form metal carbonate species and carbon dioxide. This includes selection of the rate and period of time to obtain a desired conversion, e.g., maximum conversion, of the metal precursor compound(s) to their associate metal carbonate species. The desired conversion may be about 50%, about 60%, about 70%, about 75%, or more. The conversion may be substantially complete. Here, the term "substantially" means a conversion of 90%, 95%, 98%, or 100%. Illustrative rates include from about 0.5 mL/min to about 10 mL/min, from about 1 mL/min to about 10 mL/min, or from about 1 mL/min to about 5 mL/min. Each of these rates may be reported as the rate per 100 mL of the precursor solution. Illustrative periods of time include from about 15 min to about 120 min, from about 30 min to about 100 min, or from about 30 min to about 50 min.

Both formation of the precursor solution and titration of the precursor solution with the gelling agent may take place under ambient conditions, e.g., room temperature (e.g., from about 20° C. to about 25° C.) and atmospheric pressure.

As noted above, the metal carbonate species (e.g., $Fe_2(CO_3)_3$) can be decomposed to form a metal oxyhydroxide (e.g., Equation 3). The disclosed method may further involve using microwave radiation to force the decomposition of the metal carbonate species while still in solution. This minimizes or prevents crystallization and segregation of metal atoms in the final product. The decomposition of the metal carbonate species is accompanied by the additional release of carbon dioxide to provide the disclosed metal oxyhydroxide electrocatalytic materials. The conditions under which the microwave radiation is applied (e.g., period of time, frequency, power) may be selected to maximize the decomposition of the metal carbonate species. Although some evaporation of the solvent may occur during microwave radiation, the conditions may be selected to avoid excessive boiling of the solvent. Illustrative periods of time include from about 1 s to about 10 min, from about 0.5 min to about 10 min, from about 0.5 min to about 8 min, or from about 1 min to about 5 min. In embodiments, the source of microwave radiation may be a commercially available microwave oven capable of providing microwave radiation in the frequency range of from about 2 GHz to about 1000 MHz or from about 25 GHz to about 800 MHz. It has also been found that the decomposition of the metal carbonate species may occur over a period of days, weeks, or months in the absence of exposure to microwave radiation.

The method may include additional steps. In embodiments, the method includes depositing the titrated, microwaved precursor solution (now containing the metal oxyhydroxide electrocatalytic material) onto the surface of a substrate. Various deposition techniques may be used, including drop-casting and electrophoretic deposition. Electrophoretic deposition may be carried out at about −5 V with a W, Ti, and carbon, etc. counter electrode for about 10 minutes in a two electrode system. The deposited material may be further dried, e.g., by exposure to heat for a period of time. Various temperatures (e.g., about 50-100° C. may be used) and periods of time (e.g., about 10-60 minutes) may be used. However, by contrast to conventional methods, no lengthy, high temperature annealing steps are used or required. The deposition (and drying) step provides a film of metal oxyhydroxide electrocatalytic material on the substrate.

The deposition (and drying) step may be repeated to provide a multi-layer film having a desired average thickness (by "average" it is meant the average value across the surface of the film). The average thickness may be selected to maximize the catalytic performance of the metal oxyhydroxide electrocatalytic material/film. Various average thicknesses may be used (e.g., from about 0.01 μm to about 50 μm, from about 0.1 μm to about 50 μm, from about 0.5 μm to about 30 μm, or from about 1 μm to about 20 μm).

Various substrates may be used, including those that are incompatible with conventional methods, e.g., those including high temperature annealing steps, electrodeposition, etc. Illustrative substrates include conductive substrates such as FTO-coated glass, glassy carbon, high surface area carbon, etc. The film of metal oxyhydroxide electrocatalytic material on the substrate may be used as an electrode.

The Examples below provide additional details (e.g., illustrative suitable conditions, etc.) regarding the method of making the disclosed metal oxyhydroxide electrocatalytic materials.

Due to the unique method of making the disclosed metal oxyhydroxide electrocatalytic materials involving the titration reactions and the microwave exposure, the materials (and/or films of the materials) may be distinguished (both structurally and functionally) from those made using conventional methods. Structural differences include those related to the morphology, lack of crystallinity, and homogeneity of the disclosed materials.

Figure 9:
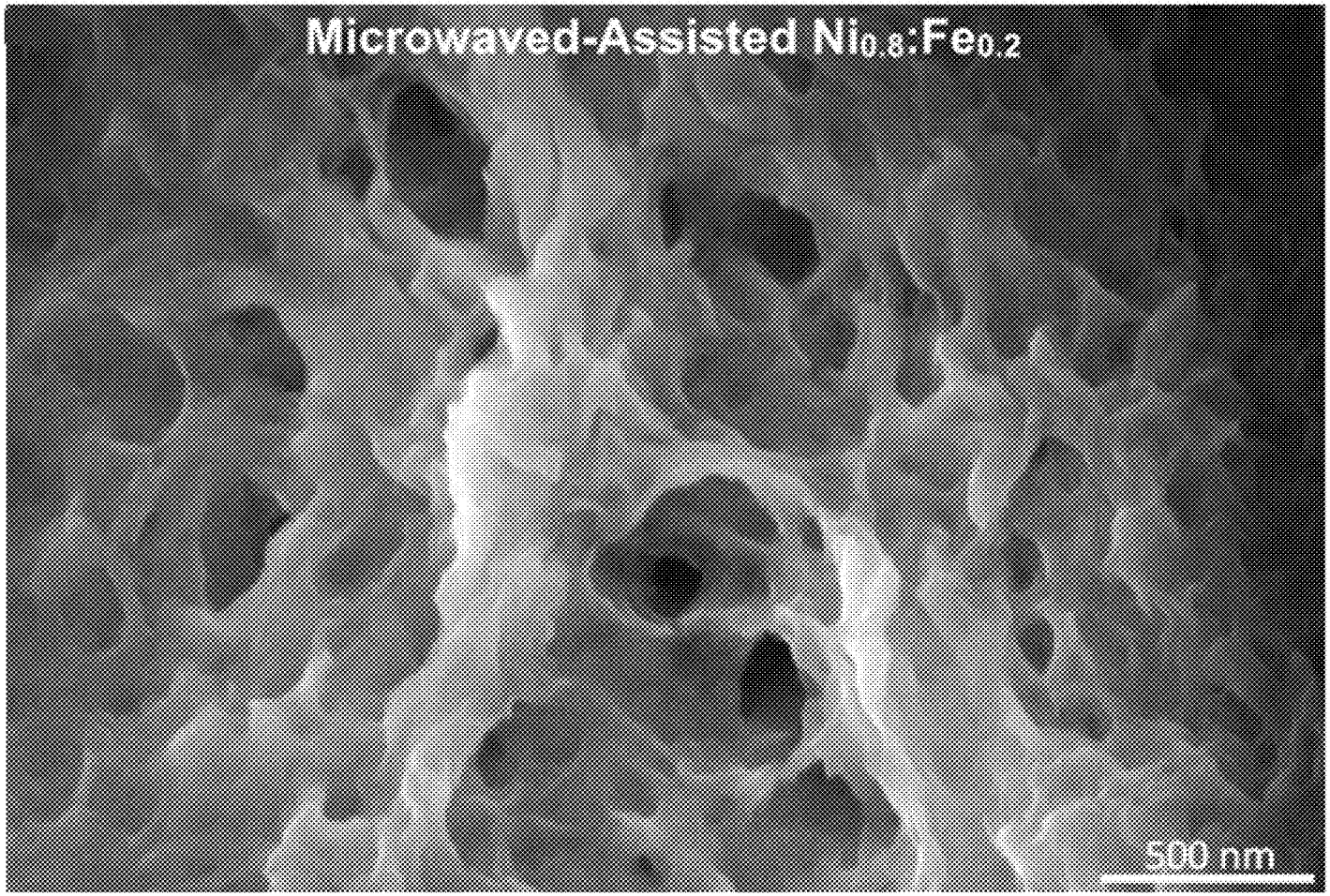
FIG. 9 shows a SEM image of the microwave-assisted $Ni_{0.8}$:$Fe_{0.2}$ catalyst, showing the morphology of the material. The morphology is that of a sponge-like network, i.e., a substantially continuous matrix having irregularly shaped pores distributed throughout the matrix. The material is devoid of any distinguishable, discrete nanostructures.
Figure 10B:
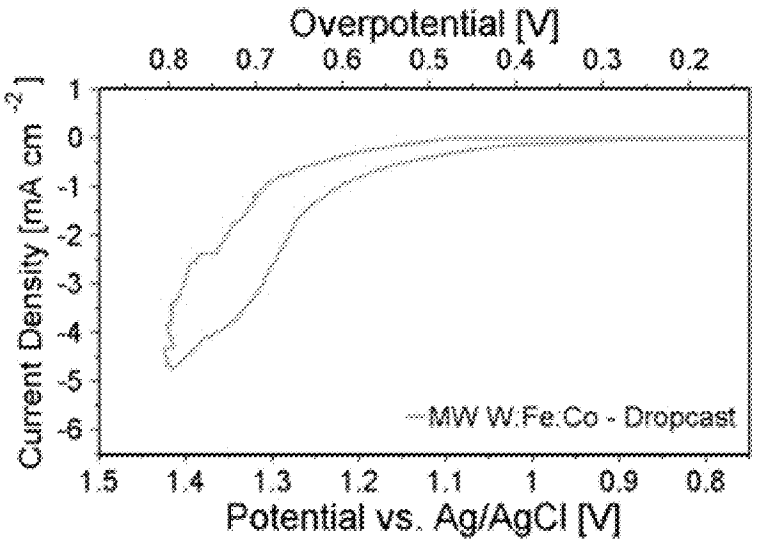
FIGS. 10A-10J show static cyclic voltammograms of various materials: microwave-assisted (MW) W:Fe:Co (FIG. 10A), MW Co (FIG. 10C), and MW $Ni_{0.8}$:$Fe_{0.2}$ (FIG. 10G) electrophoretically deposited (electrodeposited) on FTO glass. Also shown are MW W:Fe:Co (FIG. 10B), MW Co (FIG. 10D), MW Ni:Fe:Co (FIG. 10E), MW Ni:Co (FIG. 10F), and MW $Ni_{0.8}$:$Fe_{0.2}$ (FIG. 10H) dropcast on FTO glass. Also shown are crystal-derived Co (FIG. 10I) and crystalline $IrO_x$ (FIG. 10J) on FTO glass. All cyclic voltammograms were taken at 1 mV $s^{-1}$ in pH 7, 0.1 M phosphate buffer solution (PBS), and corrected for uncompensated resistance, $R_u$. Overpotentials were reported with respect to the oxygen evolution reaction (OER) in pH 7.
Figure 10A:
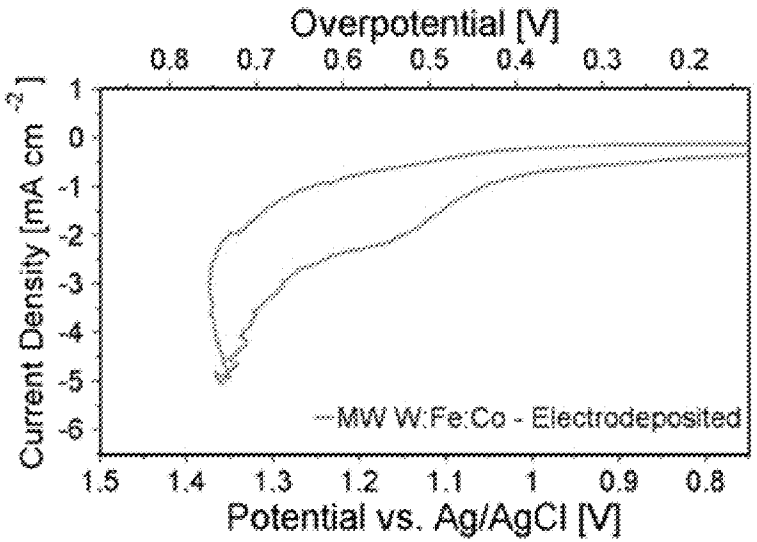
Figure 10D:
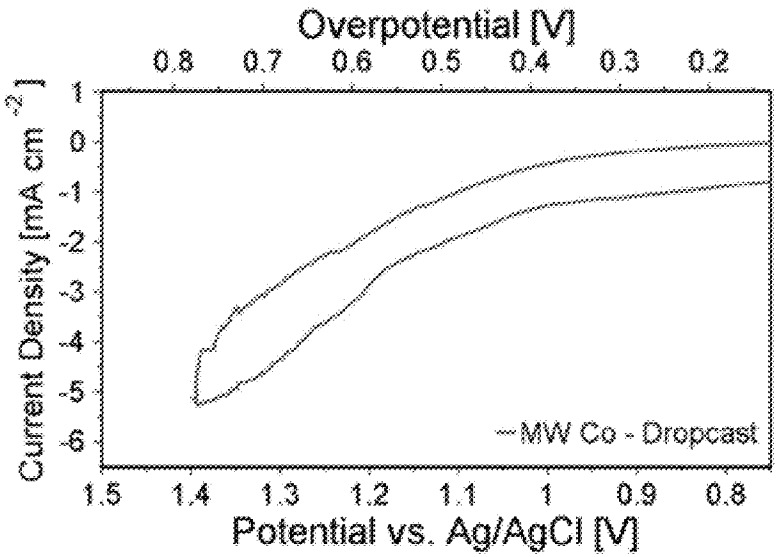
Figure 10C:
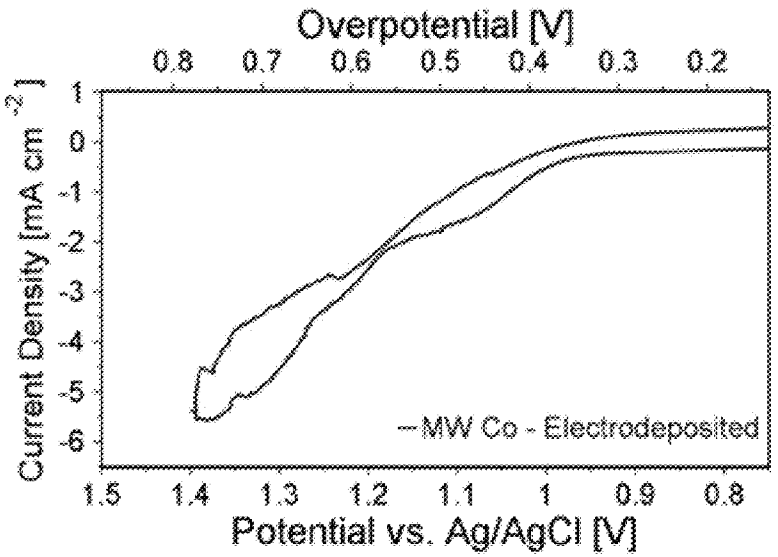
Figure 10F:
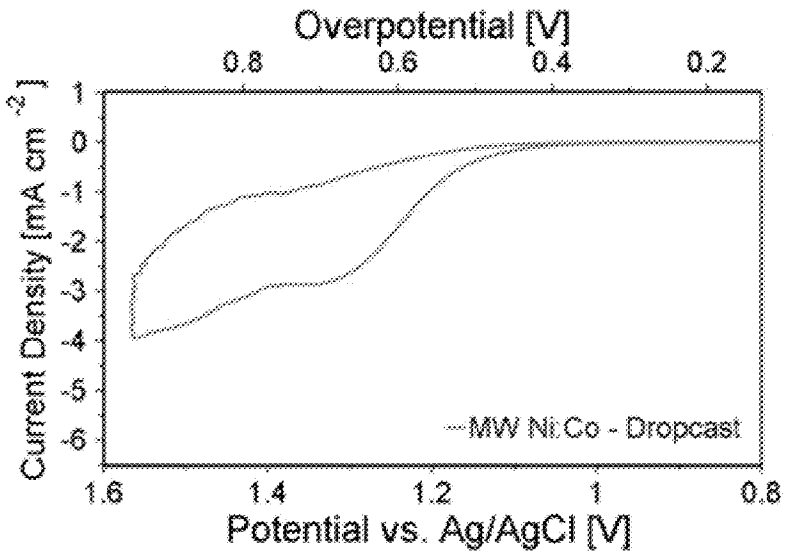
Figure 10E:
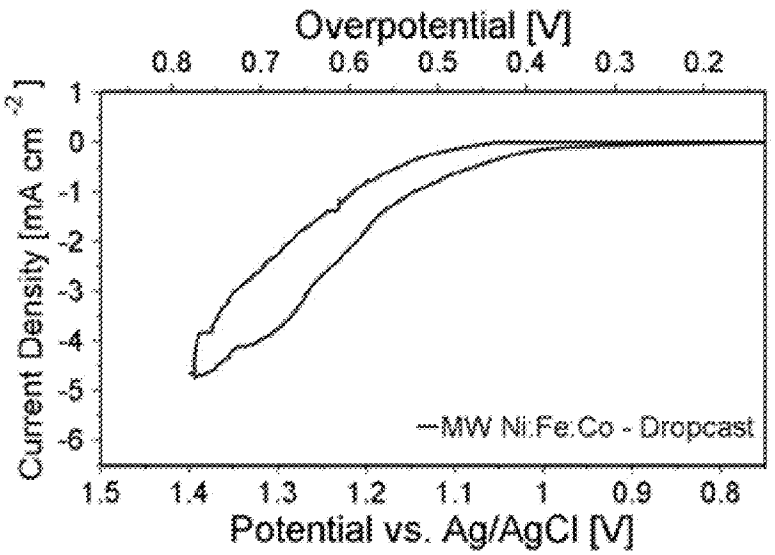
Figure 10G:
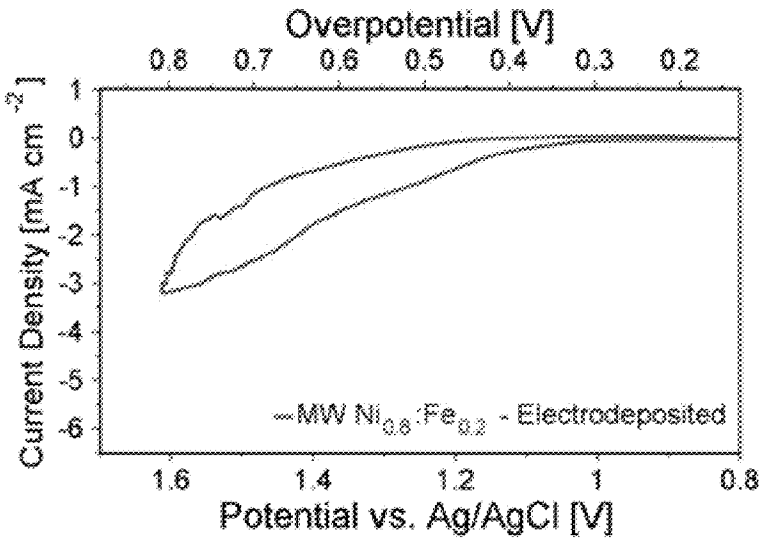
Figure 10H:
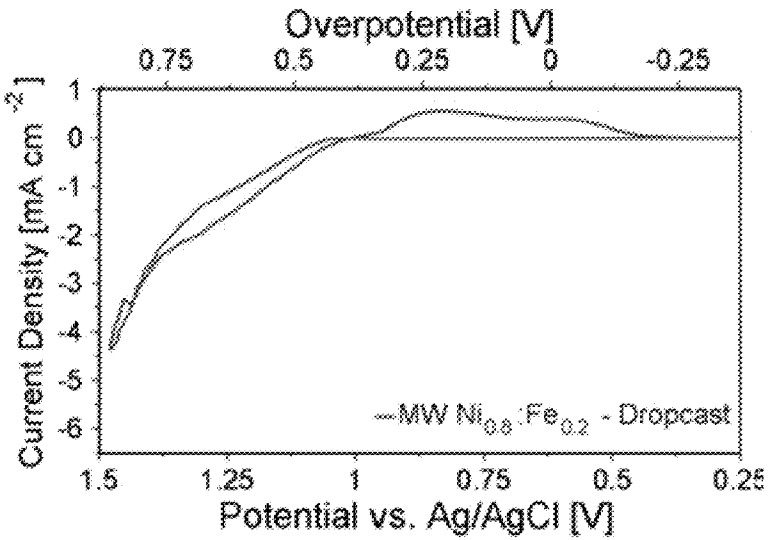
Figure 10I:
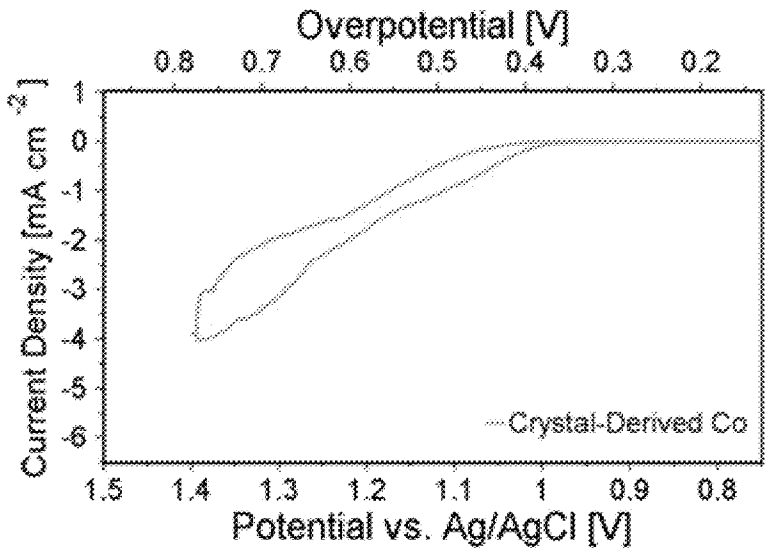
Figure 10J:
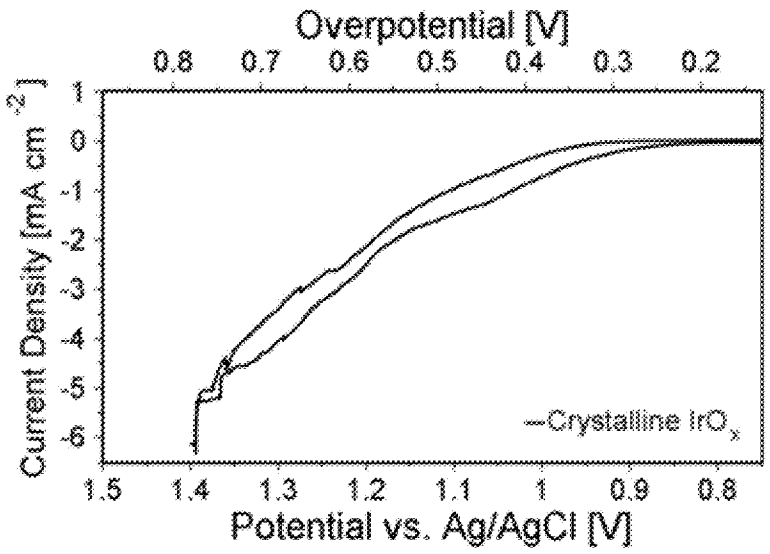
Figure 11A:
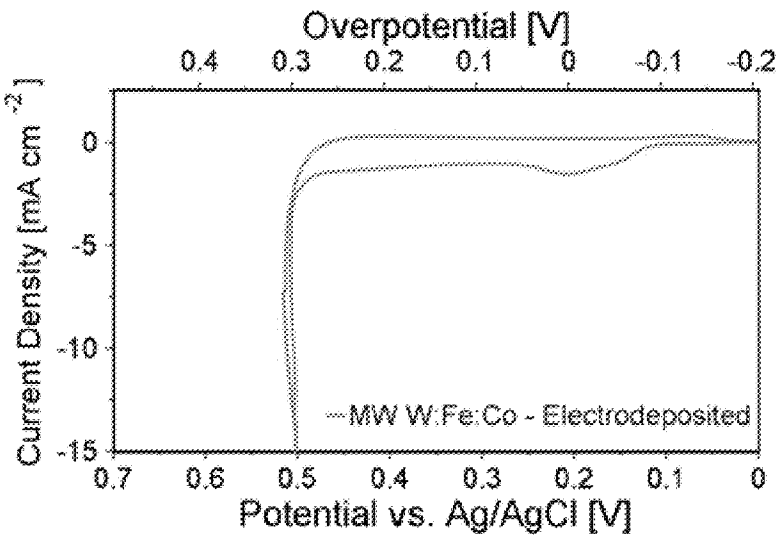
FIGS. 11A-11F show static cyclic voltammograms of various materials: microwave-assisted (MW) W:Fe:Co (FIG. 11A), MW Ni:Fe:Co (FIG. 11C), and MW Co (FIG. 11E) electrophoretically deposited (electrodeposited) on FTO glass. Also shown are MW Ni:Co (FIG. 11B), Ni:Fe:Co (FIG. 11D), and Co (FIG. 11F) dropcast on FTO glass. All cyclic voltammograms were taken at 1 mV $s^{-1}$ in pH 14, 1 M NaOH solution, and corrected for uncompensated resistance, $R_u$. Overpotentials were reported with respect to the oxygen evolution reaction (OER) in pH 14.
Figure 11B:
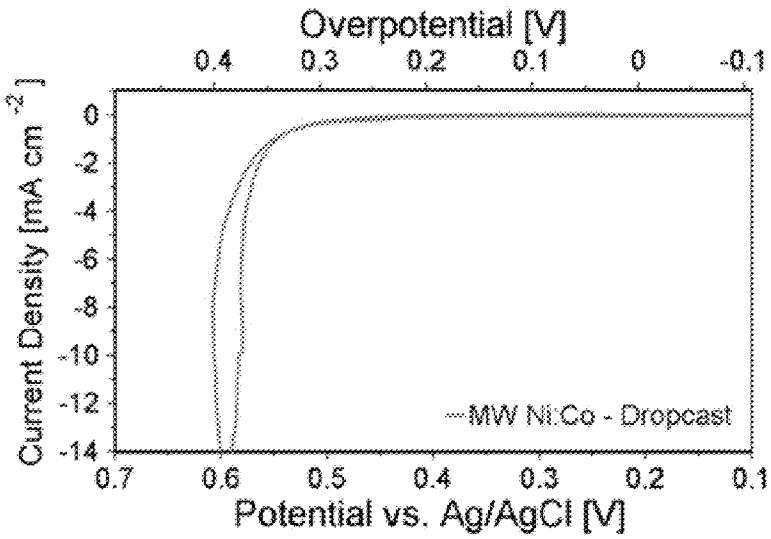
Figure 11D:
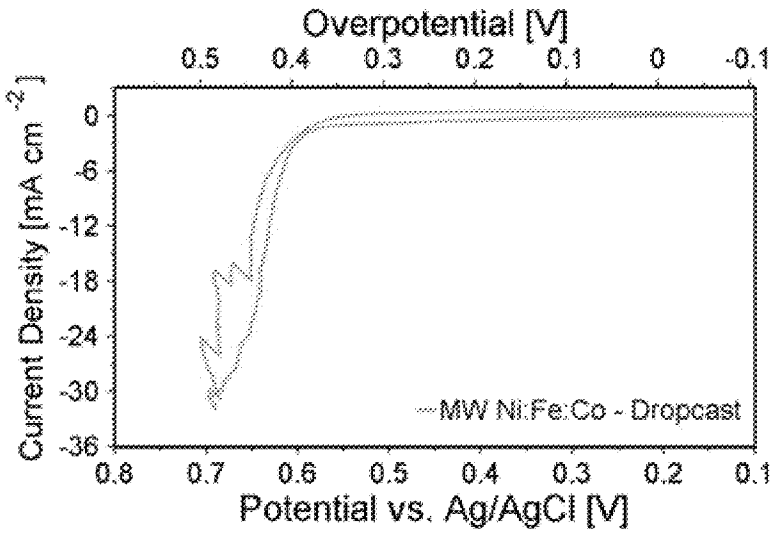
Figure 11C:
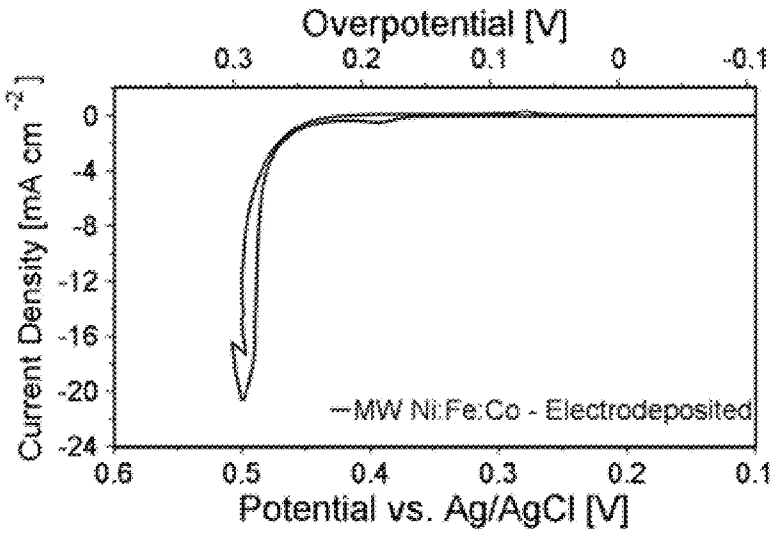
Figure 11E:
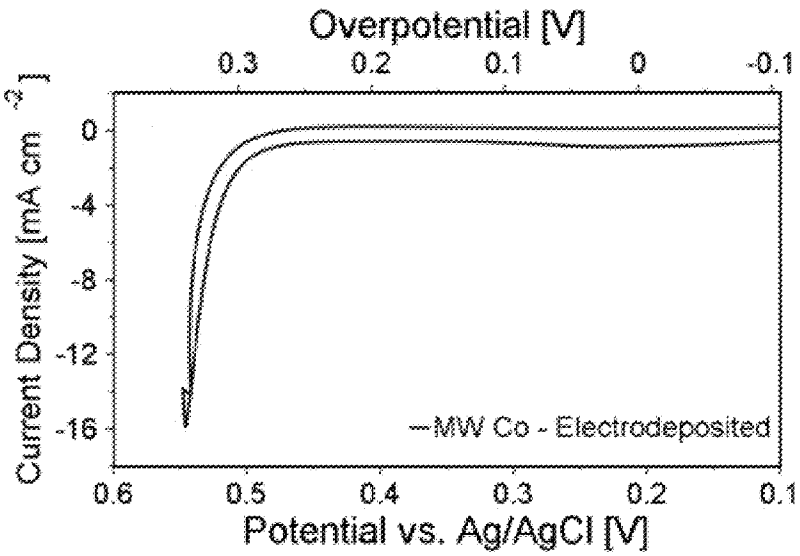
Figure 11F:
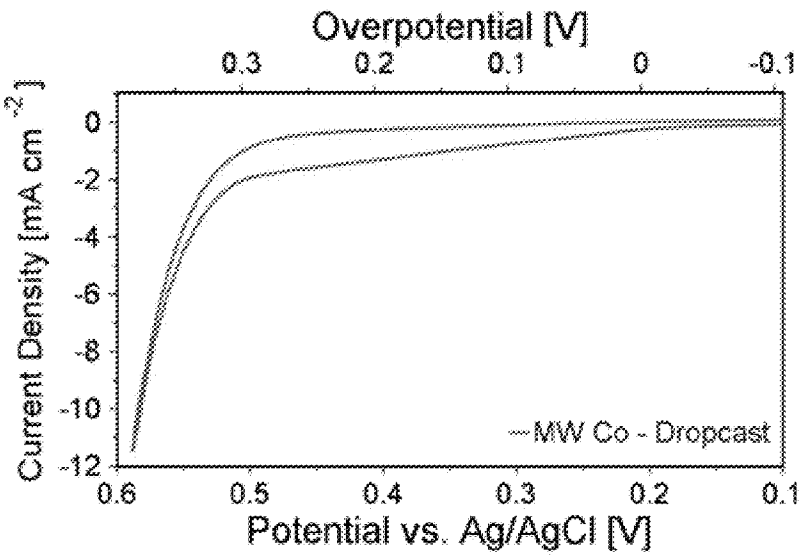

Regarding the morphology of the disclosed metal oxyhydroxide electrocatalytic materials, the physical shape of the material may be characterized as a sponge-like network, i.e., a substantially continuous matrix having irregularly shaped pores distributed throughout the matrix. By way of illustration, FIG. 9 shows a SEM image of a $Ni_{0.8}$:$Fe_{0.2}$ oxyhydroxide electrocatalytic material made using an embodiment of the disclosed methods (see Example 1, below). Noticeably, the material is devoid of any distinguishable, discrete nanostructures. A similar SEM image of the material shown in FIG. 1D also illustrates its "fluffy" nature. It is believed that the release of carbon dioxide during the titration reactions and the decomposition of the metal carbonate species as described above at least partly contributes to the unique morphology of the material. The disclosed materials are distinguished from materials formed by conventional methods in which provide a material composed of a plurality of individual, discrete particles.

Regarding the crystallinity of the disclosed metal oxyhydroxide electrocatalytic materials, the materials may be characterized as being amorphous. Surprisingly, as demonstrated by the high resolution transmission electron microscopy (HRTEM) images of an illustrative $Ni_{0.8}$:$Fe_{0.2}$ oxyhydroxide electrocatalytic material shown in FIGS. 2A-2D, the lack of crystalline order is on the nanometer scale. This is evidenced by the absence of selected area electron diffraction (SAED) spots at about a 5 nm spatial resolution in these images (see the corresponding electron diffractograms in the inlays). Thus, throughout the present disclosure, the term "nanoamorphous" may be used to describe a lack of crystalline order down to a length of about 5 nm. Furthermore, confirmation of the nanoamorphous nature may be accomplished by obtaining HRTEM electron diffraction patterns according to the technique described in the Examples, below. Confirmation of the nanoamorphous nature may also be confirmed from XRD spectra showing only peaks attributed to a salt formation byproduct (e.g., $NaNO_3$), e.g., as opposed to a hydroxyl species (e.g., $Ni(OH)_2$). (See FIG. 3A.) Although some conventional materials formed using conventional methods may use the term "amorphous" to characterize those materials, corresponding HRTEM electron diffraction patterns show that those materials actually do exhibit crystalline order on the nanometer scale, e.g., over a length of about 5 nm, and thus, could not be considered to be nanoamorphous.

Figure 3A:
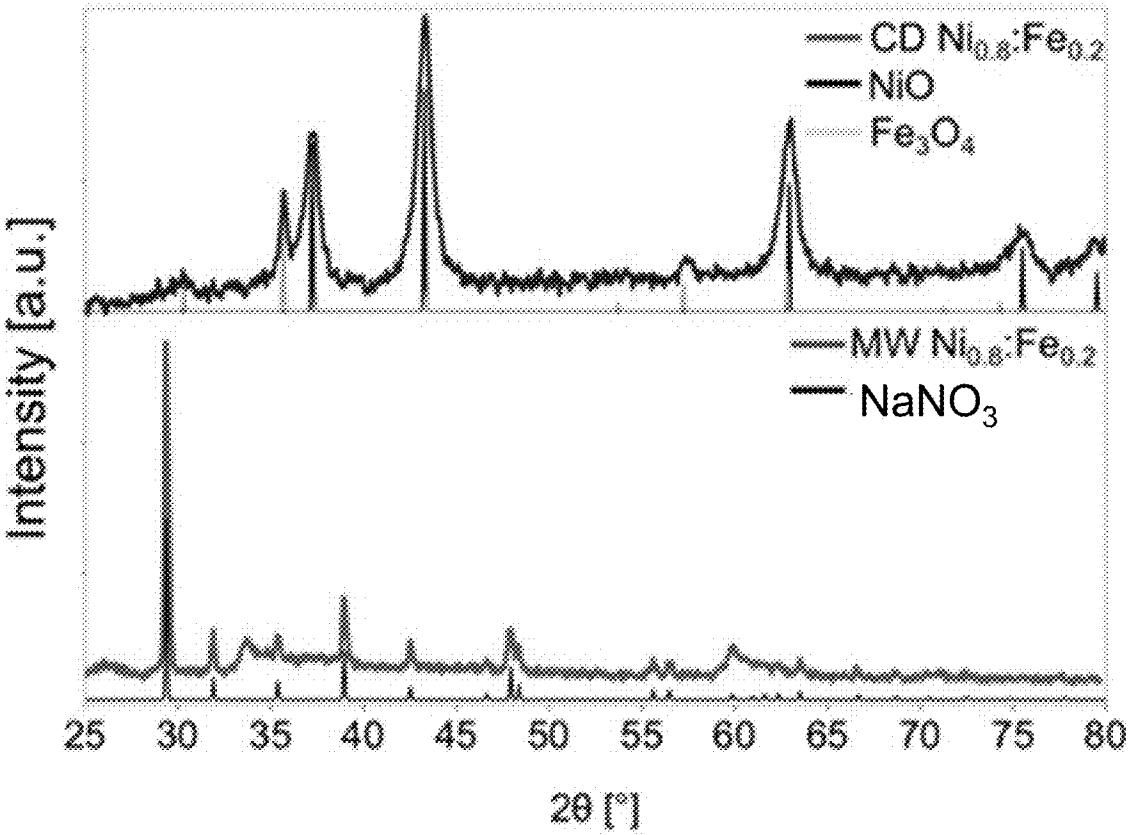
FIG. 3A shows X-ray diffraction spectra of crystal-derived $Ni_{0.8}$:$Fe_{0.2}$ oxide prior to electrochemical conditioning (top) and microwave-assisted nanoamorphous $Ni_{0.8}$:$Fe_{0.2}$ powders (bottom).
Figure 3C:
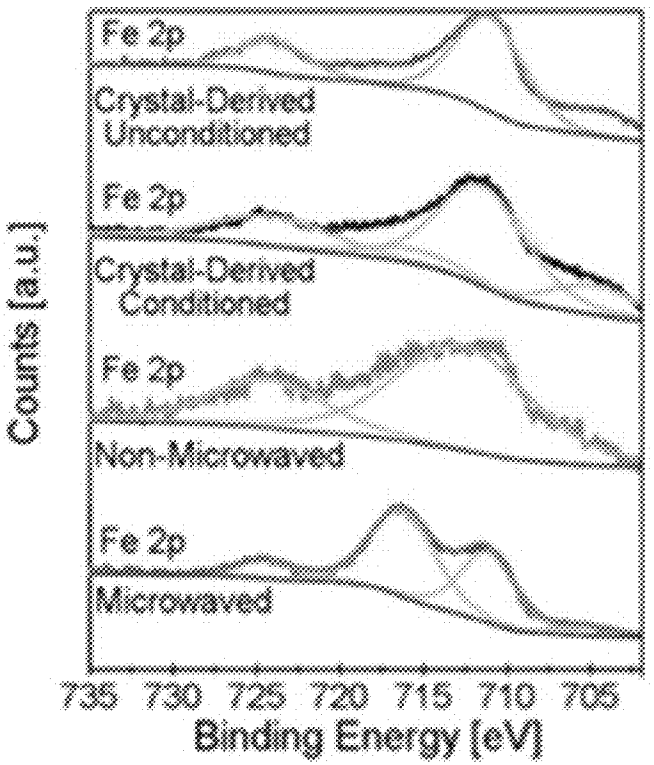
FIGS. 3B-3E show X-ray photoelectron spectroscopy of the crystal-derived $Ni_{0.8}$:$Fe_{0.2}$ oxide prior to conditioning (top spectrum), electrochemically conditioned crystal-derived $Ni_{0.8}$:$Fe_{0.2}$ oxyhydroxide (second spectrum), solution-derived (non-microwaved) $Ni_{0.8}$:$Fe_{0.2}$ (third spectrum), and microwave-assisted nanoamorphous $Ni_{0.8}$:$Fe_{0.2}$ (bottom spectrum).
Figure 3B:
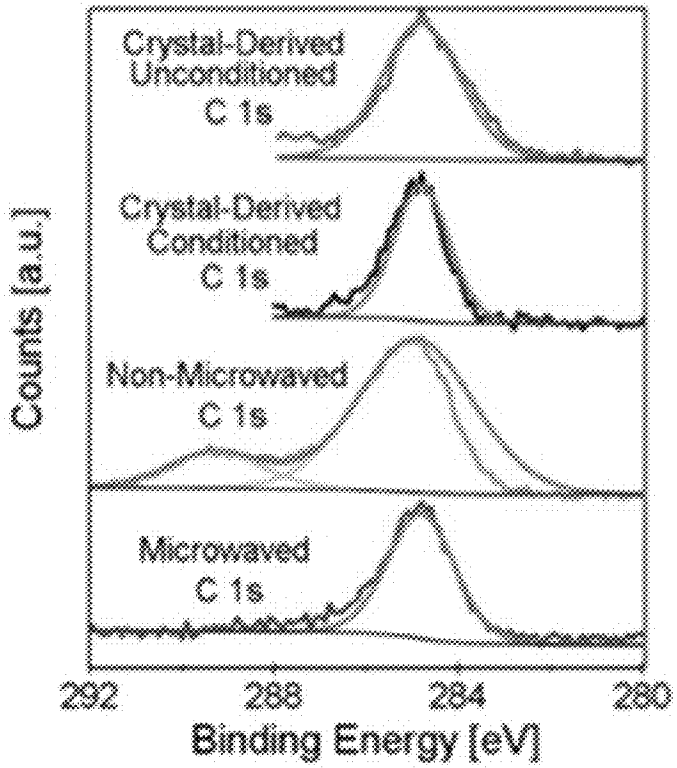
Figure 3D:
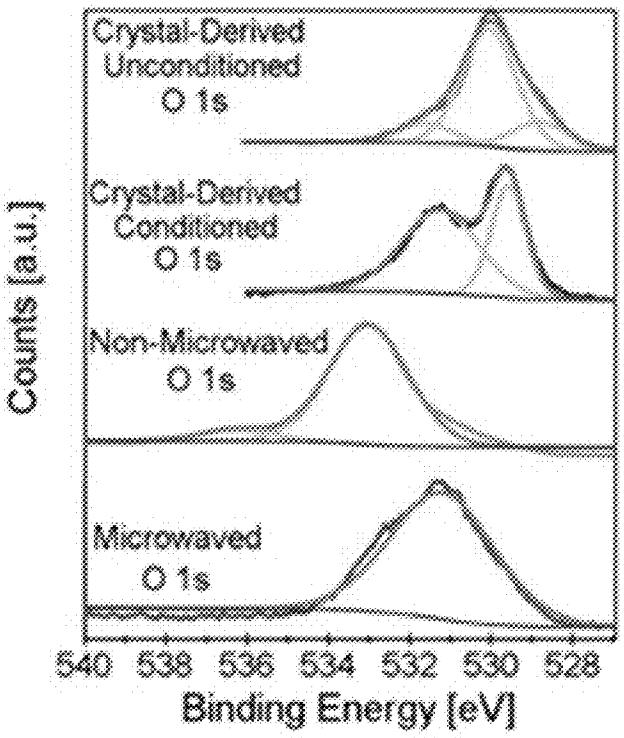
Figure 3E:
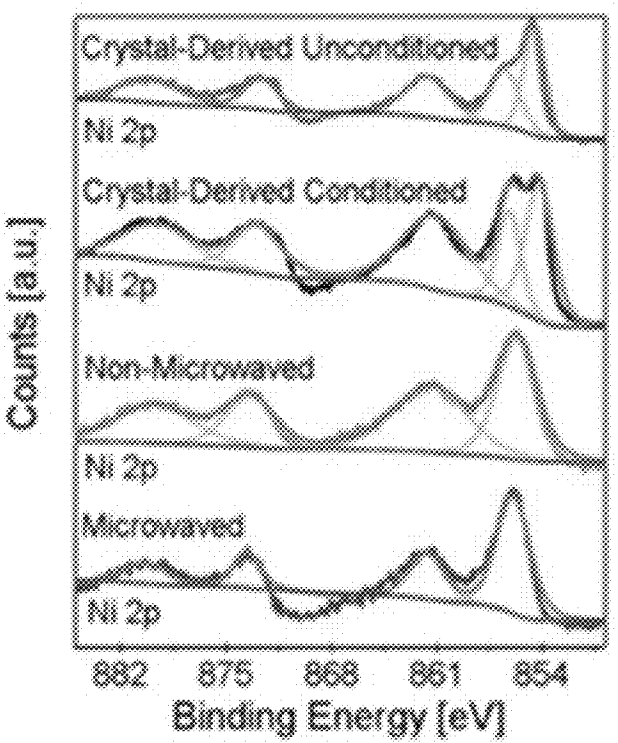

Regarding the homogeneity of the disclosed metal oxyhydroxide electrocatalytic materials, the materials may be characterized by a homogeneous distribution of metal atoms throughout the material. That is, metal atoms do not segregate into distinguishable phases. Confirmation of homogeneity and lack of metal atom segregation may be accomplished via X-ray photoelectron spectroscopy (XPS) as described in the Examples, below, which probes the arrangement of atoms and atomic bonding in a material. In at least some embodiments, the metal oxyhydroxide electrocatalytic material is characterized by oxygen (O) is XPS spectra having no more than a single peak. (See FIG. 3D, bottom spectrum.) In at least some embodiments, the metal oxyhydroxide electrocatalytic material is a nickel-iron oxyhydroxide electrocatalytic material characterized by iron (Fe) $2p_{3/2}$ XPS spectra indicative of an FeOOH-like material, e.g., as opposed to $Fe_2O_3$. (See FIG. 3C, bottom spectrum.)

The disclosed metal oxyhydroxide electrocatalytic materials (e.g., in the form of an electrode) may be used to catalyze a variety of electrochemical reactions, including oxidation reactions. The electrochemical reaction may also be a reduction reaction involving the reaction of an electrochemical reactant and free electrons to form a reduction product. In one embodiment, the metal oxyhydroxide electrocatalytic material may be used to catalyze the oxygen evolution reaction (OER) in which $H_2O$ is oxidized to produce free electrons, free hydrogen ions and $O_2$. In embodiments, the metal oxyhydroxide electrocatalytic material may catalyze OER under a variety of pH conditions, including neutral (pH~7) and alkaline (e.g., pH~14) conditions. In embodiments, the metal oxyhydroxide electrocatalytic material may catalyze HER under similar pH conditions.

The disclosed metal oxyhydroxide electrocatalytic materials may be characterized by their efficiency at catalyzing a particular electrochemical reaction, e.g., the OER. In some embodiments, the efficiency is provided as the overpotential at about 1 $mA/cm^2$ as determined in about 1 M sodium hydroxide and a scan rate of about 1 mV/s and normalized to the electrochemical surface area (ECSA) of the material. In embodiments, a nickel-iron oxyhydroxide electrocatalytic material may be characterized by an efficiency (overpotential) of no more than about 400 mV, no more than about 350, no more than about 300, no more than about 250 mV, or no more than about 200 mV as determined under these conditions.

As demonstrated in the Examples, below, at least some of the disclosed metal oxyhydroxide electrocatalytic materials have higher efficiencies as compared to conventional metal oxyhydroxide catalysts (e.g., electrochemically conditioned crystalline nickel-iron oxide) and as compared to iridium oxide catalysts. Notably, the increased efficiency is greater than would be expected based on the number of metal atoms per $nm^2$ on the surfaces of the metal oxyhydroxide electrocatalytic materials.

Electrocatalytic systems including the disclosed metal oxyhydroxide electrocatalytic materials are also provided. The electrochemical system may include an electrochemical cell configured to contain a fluid including an electrochemical reactant (e.g., a species to be oxidized to form an oxidation product, a species to be reduced to form a reduction product, or both); an electrode including a metal oxyhydroxide electrocatalytic material in contact with the fluid; and a counter electrode. Any of the metal oxyhydroxide electrocatalytic materials described herein may be used. The selection of fluid depends upon the particular electrochemical reaction to be catalyzed. For the OER, the fluid may be an electrolyte solution (e.g., a solution of water and a water-soluble electrolyte), the electrochemical reactant may include water and the oxidation product may include $O_2$ (as well as free electrons, and free hydrogen ions). Various materials for the counter electrode may be used (e.g., Pt wire). The counter electrode may include an electrocatalytic material capable of catalyzing the hydrogen evolution reaction (HER) in which hydrogen ions are reduced to $H_2$. By way of illustration, the $FeS_2$ electrocatalytic materials described in U.S. patent application Ser. No. 15/455,350, now U.S. Patent Publication No. 20180222767, which is hereby incorporated in its entirety, may be used for this purpose. Alternatively, the disclosed metal oxyhydroxides may also be used as the counter electrode to catalyze the HER. The configuration of the electrochemical cells disclosed in U.S. patent application Ser. No. 15/455,350, now U.S. Patent Publication No. 20180222767, may also be used. The electrodes may be immersed in the fluid. The electrodes may be in electrical communication with one another.

The electrocatalytic system may further include a power source in electrical communication with the electrode and the counter electrode, the power source configured to apply an electrical potential across the electrodes. Other components may be used in the electrocatalytic system, e.g., a membrane separating the electrodes, a collection cell configured to collect the oxidation/reduction product(s) from the electrochemical cell, etc.

Methods of using the disclosed metal oxyhydroxide electrocatalytic materials to catalyze an electrochemical reaction are also provided. In one embodiment, the method includes exposing a metal oxyhydroxide electrocatalytic material to a fluid including an electrochemical reactant. The exposure results in the oxidation of the electrochemical reactant (e.g., $H_2O$) at the metal oxyhydroxide electrocatalytic material-fluid interface to produce an oxidation product (e.g., $O_2$), which may be separated from the fluid and collected. The method may be carried out in the presence of another electrocatalytic material (e.g., a $FeS_2$ electrocatalytic material as described above) so that another electrochemical reactant (e.g., hydrogen ions) may be reduced at the $FeS_2$ electrocatalytic material-fluid interface to produce a reduction product (e.g., $H_2$), which may also be separated from the fluid and collected. As noted above, the disclosed metal oxyhydroxide electrocatalytic materials may be used as the counter electrode to catalyze the HER.

EXAMPLES

Figure 7:
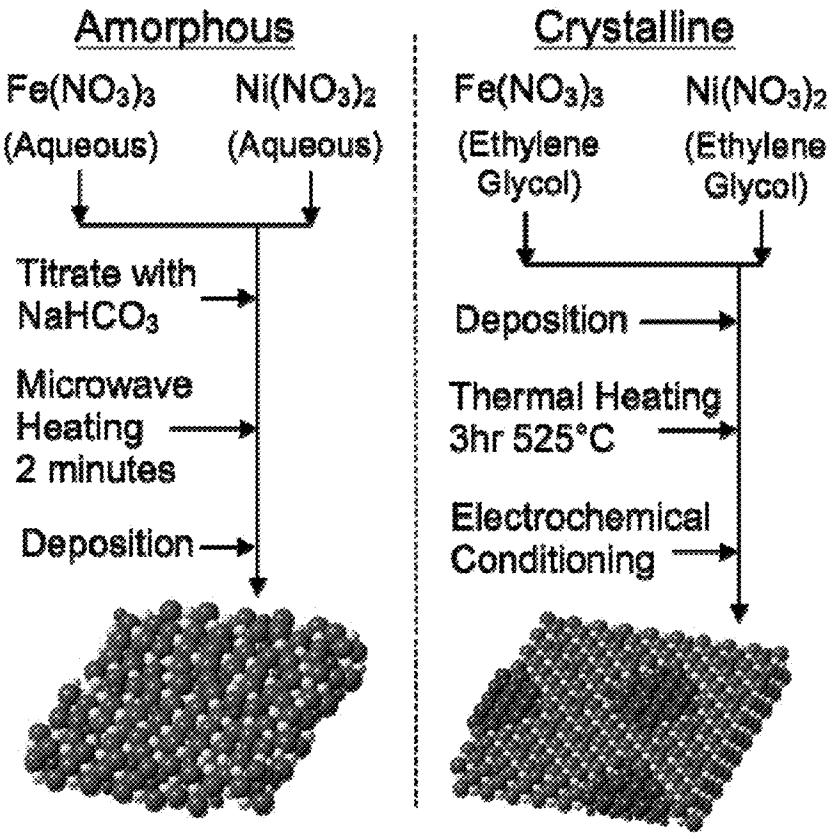
FIG. 7 illustrates the synthesis sequence of nanoamorphous $Ni_{0.8}$:$Fe_{0.2}$ oxide (left) versus crystal-derived $Ni_{0.8}$:$Fe_{0.2}$ oxyhydroxide (right), including showing the structural differences in the final products. These structural differences include the homogeneous distribution of metal atoms throughout the nanoamorphous $Ni_{0.8}$:$Fe_{0.2}$ oxide (left) as compared to the segregation of iron atoms throughout crystal-derived $Ni_{0.8}$:$Fe_{0.2}$ oxyhydroxide (right).

In the present disclosure, the term "microwave-assisted", "nanoamorphous", or both are used in reference to mixed metal oxyhydroxide electrocatalytic materials formed using the methods described in the "Detailed Description" section, above (e.g., see the illustrative left schematic in FIG. 7). For example, the terms "microwave-assisted $Ni_{0.8}$:$Fe_{0.2}$ catalyst", "microwave-assisted nanoamorphous $Ni_{0.8}$:$Fe_{0.2}$", "microwave-assisted electrodeposited (MW-E) nanoamorphous $Ni_{0.8}$:$Fe_{0.2}$", "microwave-assisted dropcast (MW-D) nanoamorphous $Ni_{0.8}$:$Fe_{0.2}$", "microwave-assisted $Ni_{1-x}$:$Fe_x$", "nanoamorphous $Ni_{0.8}$:$Fe_{0.2}$ oxide" and the like all describe nickel-iron oxyhydroxide electrocatalytic materials formed using such methods.

By contrast, the term "solution-derived" is used in reference to a material formed using these same methods except without the step of exposing to microwave radiation.

Also by contrast, the terms "crystal-derived", "crystalline", and "crystalline-derived" are used in reference to a material formed using the conventional method described in the "Crystalline-Derived Catalyst" section, below. (Also see the right schematic in FIG. 7.)

Finally, in the present disclosure, the use of the terms "$Ni_{1-x}$:$Fe_x$" and "$Ni_{0.8}$:$Fe_{0.2}$" and the like are not meant to imply the absence of oxygen, hydrogen, and/or hydroxyl groups in the materials.

Example 1

This Example reports a microwave-assisted synthesis route of creating a nanoamorphous nickel-iron oxide electrocatalyst that contains only "fast" catalytic sites. Benchmarking experiments on flat electrodes (roughness factors <1.4) showed that the microwave-assisted, nanoamorphous ($Ni_{0.8}$:$Fe_{0.2}$) oxide had a low OER overpotential of 286 mV at a current density of 10 mA $cm^{-2}$. The kinetic rate constant of the active sites was measured directly with the surface interrogation mode of scanning electrochemical microscopy (SI-SECM). It is shown that the microwave-assisted, nanoamorphous ($Ni_{0.8}$:$Fe_{0.2}$) oxide has only one type of catalytic site with an OER kinetic rate constant of 1.9 $s^{-1}$ per site—a "fast" catalytic site. This was compared to a crystalline $Ni_{0.8}Fe_{0.2}OOH$ that was synthesized via electrochemical conditioning of crystalline $Ni_{0.8}$:$Fe_{0.2}$ oxide. It was verified that the $Ni_{0.8}Fe_{0.2}OOH$ contained two types of catalytic sites—"fast" sites with an OER rate constant of 1.3 $s^{-1}$ per site and "slow" sites with a OER rate constant of 0.05 $s^{-1}$ per site. The percentage of "fast" sites in the crystalline $Ni_{0.8}Fe_{0.2}OOH$ was well matched to the total iron atom content, while 100% of the sites were "fast" in the microwave-assisted, nanoamorphous ($Ni_{0.8}$:$Fe_{0.2}$) oxide.

Materials and Methods

Chemicals

Iron (III) nitrate nonahydrate (98%+, ACS Reagent, Acros), nickel (II) nitrate hexahydrate (99%, Fisher Scientific), iridium (III) chloride (99.99%, Alfa Aesar), sodium hydroxide (>97%, Fisher Scientific), ethylene glycol (99.8%, anhydrous, Sigma Aldrich), sodium bicarbonate (Fisher Scientific), potassium hydroxide (85%, Acros Organics), iron (III) sulfate hydrate (Reagent Grade, Alfa Aesar), triethanolamine (97%, Acros Organics) were all used as received without additional purification.

Catalyst Synthesis

Crystalline-Derived Catalyst:

Crystalline thin-films of $Ni_{0.8}$:$Fe_{0.2}$ oxide were made similar to those previously reported.[54] Briefly, two solutions, one of 0.02 M $Ni(NO_3)_2.6H_2O$ and the other of 0.02 M $Fe(NO_3)_3.9H_2O$, were prepared separately in ethylene glycol and subsequently mixed in an 8:2 ratio. The solution was dropcast and annealed on fluorine-doped tin oxide (FTO) coated glass (Sigma-Aldrich) to create the $Ni_{0.8}$:$Fe_{0.2}$ oxide as described in the "Electrode Fabrication" section, below. The oxide was then electrochemically conditioned by applying an oxidation current of ca. 10 mA $cm^{-2}$ for 1 hour, as has been previously described.[25]

Nanoamorphous Microwave-Assisted Catalysts:

First, a nanoamorphous Fe catalyst was synthesized using a sol-gel method similar to a previously reported method with some modifications.[55,56] Briefly, 8.08 grams of $Fe(NO_3)_3.9H_2O$ was dissolved in 100 mL of 18.2 MΩ water. Separately, 1.99 grams of $NaHCO_3$ was dissolved in 100 mL of 18.2 MΩ water. Both solutions were sonicated until fully dissolved. The $Fe(NO_3)_3.9H_2O$ was placed in a 250 mL Erlenmeyer flask with a Teflon stir bar and placed on a stir plate. The $NaHCO_3$ was placed in a burette and was used to titrate at a rate of 2-3 drops per second to achieve a rate of 2.5-3 mL/min rate while rapidly stirring the $Fe(NO_3)_3$ solution. The suspension underwent a gradual color change from orange to deep red at the end. The total titration time was about 40-45 minutes, and the solution continued to stir for one hour after titration. This suspension was then placed in Nalgene bottles to be microwaved. The solution was microwaved for about two minutes, with swirling every 15-20 seconds to mix the contents, in a conventional 1050 W microwave (Rival). After two minutes of microwaving, the solution had begun to boil with bubbles on the sides of the bottles. To form the nanoamorphous Ni catalyst, this procedure was repeated by replacing the $Fe(NO_3)_3.9H_2O$ with 5.82 grams of $Ni(NO_3)_2.6H_2O$. After microwaving the nickel suspension, some separation occurred. To form the nanoamorphous mixed-metal catalysts, this procedure was repeated except the $Ni(NO_3)_2.6H_2O$ and $Fe(NO_3)_3.9H_2O$ were mixed to create two additional solutions at 1:1 and 8:2 molar ratios, respectively. These solutions were titrated and microwaved as described above. Some separation also occurred in the nanoamorphous mixed-metal suspensions. Electrodes were made by dropcasting the suspensions, both with and without the microwave step, on FTO-coated glass and were dried at 70° C. as described in the "Electrode Fabrication" section, below. After dropcasting, the samples were gently rinsed with 18.2 MS water to remove any material that was not well adhered to the surface. This left a nearly transparent film of the nanoamorphous $Ni_{1-x}:Fe_x$ catalyst on the FTO-coated glass. Additionally, the microwave-assisted nanoamorphous $Ni_{0.8}:Fe_{0.2}$ was deposited via electrophoretic deposition on FTO-coated glass to compare to the dropcast samples on FTO. The nanoamorphous $Ni_{0.8}:Fe_{0.2}$ was also electrophoretically deposited onto a glassy carbon rotating disc electrode (RDE) for benchmarking, and solution-derived (non-microwaved) and microwave-assisted $Ni_{0.8}:Fe_{0.2}$ were dropcast on a glassy carbon RDE for comparison. Electrophoretic deposition was performed by applying −5 V to the working electrode for 10 minutes in a two electrode system with a Ti counter electrode.

Electrode Fabrication

Drop-Cast Thin Films:

FTO glass sheets (Sigma Aldrich) cut to 0.5-inch squares were cleaned by washing with soap, deionized water, and ethanol. The FTO pieces were placed in a beaker with ethanol and sonicated for 10 minutes. The slides were dried at room temperature for about 5 minutes. Then, using a micropipette, approximately 250 μL of solution was dropped onto each square in the most even thin layer possible. The slides were then placed into an oven at 135° C. for about 30 minutes. This was repeated once more for a second coating. After coating the FTO glass, the crystalline thin-film samples were fired in air at 500° C. for 3 hours with a 1° C. $min^{-1}$ ramp rate. For each sample, a 2-3 mm edge of coating was scraped off and copper wire tape (Electron Microscopy Sciences) was placed on and scored.

Drop-Cast Solution-Derived and Microwave-Assisted Films:

FTO glass sheets were cut and cleaned as described above. Using a micropipette, approximately 250 μL of the suspension was dropped onto each square in the most even thin layer possible. The slides were then placed into an oven at 70° C. for about 30 minutes. This was repeated once more for a second coating. No additional annealing was applied to the electrode. For suspensions where separation occurred, the suspension was pipetted from the bottom of the container.

Masked Substrate:

The substrate in the scanning electrochemical microscopy (SECM) experiment was a catalyst sample drop-cast on FTO glass (Sigma-Aldrich) and masked to create a pseudo-ultramicroelectrode suitable for surface interrogation mode of SECM. To make the mask, a 2 cm×2 cm square of Teflon FEP Film (50A, American Durafilm) was taped to a Teflon block, which was fixed in the clamp of a CNC Mill. A hole was drilled in the FEP film with a 100 μm diameter drill bit (One Piece, Drill Bits Unlimited). The FEP film mask was placed over the catalyst-coated FTO glass with the hole centered and the excess FEP film trimmed off. The masked substrate was placed in the furnace above 271° C. for 30 minutes to allow the FEP film to heat-bond to the substrate.

Glassy Carbon Ultramicroelectrode:

The glassy carbon (GC) ultramicroelectrode utilized as the SECM tip was fabricated similar to the procedure previously reported with some modifications.[15] A 1 cm GC rod (type 2, 1 mm diameter, Alfa Aesar) was electrochemically etched in 4 M KOH by submersing half of the rod and applying 5 V using a graphite counter electrode for 500 s. Subsequently, the rod was flipped and the other end of the rod was electrochemically etched in the same manner. The etching process was repeated, alternating the end of the rod and lowering the etch time as needed, until a sharp GC needle was obtained. The GC needle was rinsed with acetone and deionized water and allowed to dry completely. A silver connection wire (30 AWG, Belden, USA) coated with conductive silver epoxy (Circuit Works, USA) was inserted into one end of a borosilicate glass capillary (1 mm O.D., 0.5 mm I.D., Sutter Instruments, USA). The other end of the borosilicate glass capillary was filled with silver epoxy and the etched GC needle with one end coated in silver epoxy was inserted. The conductive wire was pushed against the GC needle inside the capillary to ensure good electrical contact. The silver epoxy in the electrode was dried in the oven at 120° C. for 30 minutes with the GC tip pointing upwards. The GC tip was completely coated in epoxy (1C&EPKC, Loctite Hysol) and dried in the oven with the GC tip pointing upwards at 120° C., removing the electrode to recoat/remold the epoxy every 20 s until sufficiently coated. Finally, the electrode was dried in the oven at 120° C. for 2 hours to hasten the curing of the epoxy. After the epoxy was fully cured, the tip of the electrode was polished with MicroCloth polishing disks (Beuhler, Canada) until a GC disc was visible. The electrode tip was also sharpened with the MicroCloth polishing disc until the desired RG was reached. Before experimentation, the GC disc was polished with alumina micropolish (1 μm, Beuhler, Canada) until it possessed a mirror-like surface.

Other Synthesis

Redox Mediator:

A Fe(III)-TEA solution was prepared according to a previously reported procedure. (See Arroyo-Currás, N.; Bard, A. J., *J. Phys. Chem. C* 2015, 119, 8147-8154.) Briefly, 3.2 g of NaOH were added to 10 mL of deionized water while stirring and cooling in a 25° C. water bath. Separately, 20 mL of deionized water was bubbled with argon in a round-bottom flask for 5 minutes. While stirring, 214.4 mg of $Fe_2(SO_4)_3.xH_2O$ were added to the round-bottom flask. 104 μL of triethanolamine (TEA) were added dropwise to the round-bottom flask. The NaOH solution was added dropwise to the Fe(III)+ligand solution and the volume was adjusted to 40 mL with deionized water.

Crystalline $IrO_x$:

The crystalline thin-films of $IrO_x$ were made similar to the crystalline-derived $Ni_{0.8}:Fe_{0.2}$ described above. Briefly, a solution of 0.02 M $IrCl_3$ was prepared in ethylene glycol, and the solution was drop-cast and annealed on FTO coated glass (further details can be found in Electrode Fabrication section above).

Materials Characterization

Scanning electron microscope (SEM) images and Energy Dispersive X-Ray Spectrometry (EDS) images were obtained using a FEI Versa 3D Dual Beam SEM. X-ray Diffraction (XRD) data were collected on a Bruker D8 Discover with DaVinci diffractometer, in the standard Bragg-Brentano para-focusing configuration utilizing sealed tube CuK$\overline{\alpha}$ radiation ($\lambda$=1.5418 Å) operated at 40 kV and 40 mA. The sample was mounted using a zero background holder (ZBH) on a horizontal sample stage for an 830 mm diameter goniometer equipped with a 1D Lynxeye detector. Data were collected using a step width of 0.02° and step time of 0.3 s with a 2θ range of 20.0°-100.0°. X-ray photoelectron spectroscopy (XPS, Physical Electronics, Inc USA) was used to obtain binding energies of the C 1s, O 1s, Fe 2p, and Ni 2p orbitals using a monochromatic Al X-ray source. The adventitious carbon 1S binding energies for all XPS measurements were taken to be 284.8 eV.

Electrochemical Characterization

Cyclic voltammetry (CV) was performed on the catalyst coated FTO electrodes in a custom Teflon cell with a holding place for a Ag/AgCl reference electrode with porous Teflon tip (CH Instruments). The size of all FTO glass working electrodes was 0.49 $cm^2$ except for those used in the non-microwaved vs microwaved comparison (See FIG. 1C), which were 0.97 $cm^2$. A 200 Lm Pt wire (Electron Microscopy Instruments) was used as the counter electrode, and the CV experiments were performed in 1 M NaOH. All electrochemical measurements were obtained via a CH Instruments (Austin, Tex.) potentiostat.

Benchmarking experiments (i.e. cyclic voltammetry, chronopotentiometry, chronoamperometry) were performed on a catalyst coated glassy carbon custom rotating disc electrode (RDE), 0.071 $cm^2$, in a glass cell with a Ag/AgCl reference electrode with porous Teflon tip (CH Instruments) and a Pt counter electrode (CH Instruments). All RDE experiments were operated at 1600 rpm in 1 M NaOH.

The SECM Instrumentation utilized for the surface interrogation experiments was described previously.[61] Before each SECM experiment, the 2 M NaOH c.a. 50 mM Fe(III)-TEA ($E^0$=−0.012 V vs RHE in 2 M NaOH) solution (synthesis described in "Other Synthesis" above) was bubbled with argon for 10 minutes. The experiments were carried out in a custom Teflon cell holding the masked crystal-derived or microwave-assisted $Ni_{0.8}$:$Fe_{0.2}$ oxyhydroxide on FTO glass substrate as the working electrode, a 200 μm Pt wire (Electron Microscopy Instruments) as the counter electrode, and a Ag/AgCl electrode with porous Teflon tip (CH Instruments) as the reference electrode. The SECM tip, a glassy carbon (GC) ultramicroelectrode, a=29 μm (fabrication described in "Electrode Fabrication" above), was held at −0.162 V vs RHE while it was approached to an insulating portion of the masked substrate until a current enhancement of 0.3 was reached (Appendix Figure S1).

The SECM Instrumentation utilized for the surface interrogation experiments was described previously.[57] Before each SECM experiment, the 2 M NaOH ca. 50 mM Fe(III)-TEA ($E^0$=−1.05 V vs Ag/AgCl in 2 M NaOH) solution (synthesis described in "Other Synthesis" above) was bubbled with argon for 10 minutes. The experiments were carried out in a custom Teflon cell holding the masked crystal-derived oxyhydroxide or microwave-assisted nano-amorphous $Ni_{0.8}$:$Fe_{0.2}$ on FTO glass substrate as the working electrode, a 200 μm Pt wire (Electron Microscopy Instruments) as the counter electrode, and a Ag/AgCl electrode with porous Teflon tip (CH Instruments) as the reference electrode. The SECM tip, a glassy carbon (GC) ultramicroelectrode, a=29 μm (fabrication described in "Electrode Fabrication" above), was held at −1.1 V vs Ag/AgCl while it was approached to the approximate location of hole in the masked substrate until a current enhancement of 0.4 was reached (data not shown).

Electrochemical reactivity maps, ranging in size from 200-1600 μm×200-1600 μm, were performed, with step sizes ranging from 10-40 μm and a sample interval of 2 s, until the location of the hole was apparent (data not shown). The GC tip was positioned near the hole and re-approached to a current enhancement of 0.3 before moving the GC tip directly over the hole. For the surface interrogation experiment, a potential step with a 20 s duration was performed on the catalyst with 0.383 V overpotential. Immediately following, the substrate was brought to open circuit for a delay time ranging from 0-2000 ms before a potential step was applied to the GC tip electrode at −1.1 V vs Ag/AgCl with pulse width of 180 s. Finite element analysis simulations were performed with COMSOL Multiphysics v. 5.2 (additional details below).

COMSOL Multiphysics Simulations

COMSOL (COMSOL Multiphysics v. 5.2) simulations were performed to obtain the negative feedback current for the SI-SECM experiments. In COMSOL a 2D axial-symmetric domain was created to simulate the actual size of the SECM tip electrode, the size and thickness of the masked catalyst electrode, and the tip/substrate distance as described in the main paper (image not shown). Two separate edge meshes were used, (1) on the SECM tip boundary, and (2) on the catalyst electrode boundary extending up and halfway across the FEP mask. These edge meshes had a maximum element size of 0.5 μm and a minimum element size of 0.05 μm. A free triangular mesh was used for the solution using COMSOL's built-in "fine" element size, which was calibrated for fluid dynamics.

The COMSOL Electroanalysis module was used to simulate the SECM tip current during the surface interrogation experiment. This module couples Fick's Law of Diffusion with the Butler-Volmer Equation to obtain the concentration of the oxidized and reduced species in solution, as well as the current on the electro-active boundary as a function of applied potential. Since the reduction of Fe(III)-TEA to Fe(II)-TEA is a fast outer-sphere, one-electron transfer, 1 cm/s was used as the electron-transfer kinetic rate constant and a=0.5 for the transfer coefficient. The diffusion coefficient for both the Fe(III)-TEA and Fe(II)-TEA species was 2E-6 $cm^2$/s as previously reported. (See Arroyo-Currás, N.; Bard, A. J., *J. Phys. Chem. C* 2015, 119, 8147-8154.) The tip potential in the simulations was exactly as it was in the experiment. The tip/substrate distance was 7 microns above the surface of the FEP mask. The initial concentration of redox mediator, Fe(III)-TEA, used was 28 mM for the crystal-derived $Ni_{0.8}$:$Fe_{0.2}$ and 65 mM for the microwave-assisted $Ni_{0.8}$:$Fe_{0.2}$ (different concentrations of redox mediator were attributed to evaporative losses of solution from argon bubbling in between experiments).

Results and Discussion

Materials Synthesis

FIG. 7 compares the synthesis routes of the nanoamorphous (Ni,Fe) oxide using the microwave-assisted technique, to the synthesis route of the crystal-derived $Ni_{1-x}Fe_xOOH$. Both techniques start with iron nitrate and nickel nitrate precursors. To fabricate the crystal-derived $Ni_{1-x}Fe_xOOH$, a previously reported method was utilized where Fe-doped NiO rock salt structures are converted to nickel-iron oxyhydroxides via electrochemical conditioning.[25] The rock salt structure (see XRD analysis under Materials Characterization) was fabricated by depositing solutions of these nitrate salts in ethylene glycol on a fluorine-doped tin oxide (FTO) coated glass substrate, followed by annealing in air at 525° C. for 3 hours.[54] To fabricate the nanoamorphous structure, a method was devised that allowed control of the Ni:Fe ratio and formation of the oxide structure without excessive heating to avoid crystallization and segregation. To accomplish this, a titration technique was used to form nickel-iron carbonates, and then a microwave-heating step was applied to decompose the carbonate and form an amorphous oxide structure. For example, when an aqueous solution containing $Fe(NO_3)_3$ is titrated with $NaHCO_3$, the iron and carbonate ions will form iron (III) bicarbonate (Equation 1), which spontaneously decomposes to iron (III) carbonate as a precipitate (Equation 2) (See XPS analysis under Materials Characterization). Iron (III) carbonate is inactive for the OER, but it decomposes further to produce the active iron oxide (Equation 3) at temperatures below 100° C.[58] The microwave-heating step was applied to force the decomposition of the carbonate species to the oxide species while still in solution, so that the crystallization and segregation do not occur.

$$Fe^{3+}+3HCO_3^- \rightarrow Fe(HCO_3)_3 \quad \text{(Equation 1)}$$

$$2Fe(HCO_3)_3 \rightarrow Fe_2(CO_3)_3+3CO_2+3H_2O \quad \text{(Equation 2)}$$

$$Fe_2(CO_3)_3 \rightarrow \text{iron oxides}+3CO_2 \quad \text{(Equation 3)}$$

Materials Characterization

SEM images of the crystal-derived $Ni_{0.8}$:$Fe_{0.2}$ prior to electrochemical conditioning (FIG. 1A) show a catalyst layer with some catalyst cracking occurring due to the annealing step. This formed macroparticles ca. 10's of μm in size. These macroparticles have some porosity and are not single crystals (FIG. 1B). EDS measurements show a uniform distribution of Fe and Ni in these macroparticles (data not shown), and show that the nickel to iron ratio is approximately $Ni_{0.8}$:$Fe_{0.2}$. SEM images of the solution-derived (non-microwaved) structure (FIGS. 1E, 1F) show uniform macroparticles of ca. 50-100 μm in size. These macroparticles are fairly smooth with little surface variation. When the microwave-heating step was applied, the structure changes into an amorphous network, presumably from the release of $CO_2$ that occurs during the decomposition of the carbonate species (FIGS. 1C, 1D). Another SEM image of the microwave-assisted structure is shown in FIG. 9. Due to the different synthetic methods, there is no decomposition of metal carbonate species (e.g., $Fe_2(CO_3)_3$) followed by release of $CO_2$ for the crystal-derived structures. Similarly, the solution-derived structures do not exhibit decomposition of metal carbonate species and release of CO2 over the timescale of the synthesis and characterization in this Example. EDS measurements on the microwave-assisted structure also show uniform distribution of Fe and Ni and an approximate nickel to iron ratio of $Ni_{0.8}$:$Fe_{0.2}$ (data not shown).

Figures 2A, 2B, 2C, 2D:
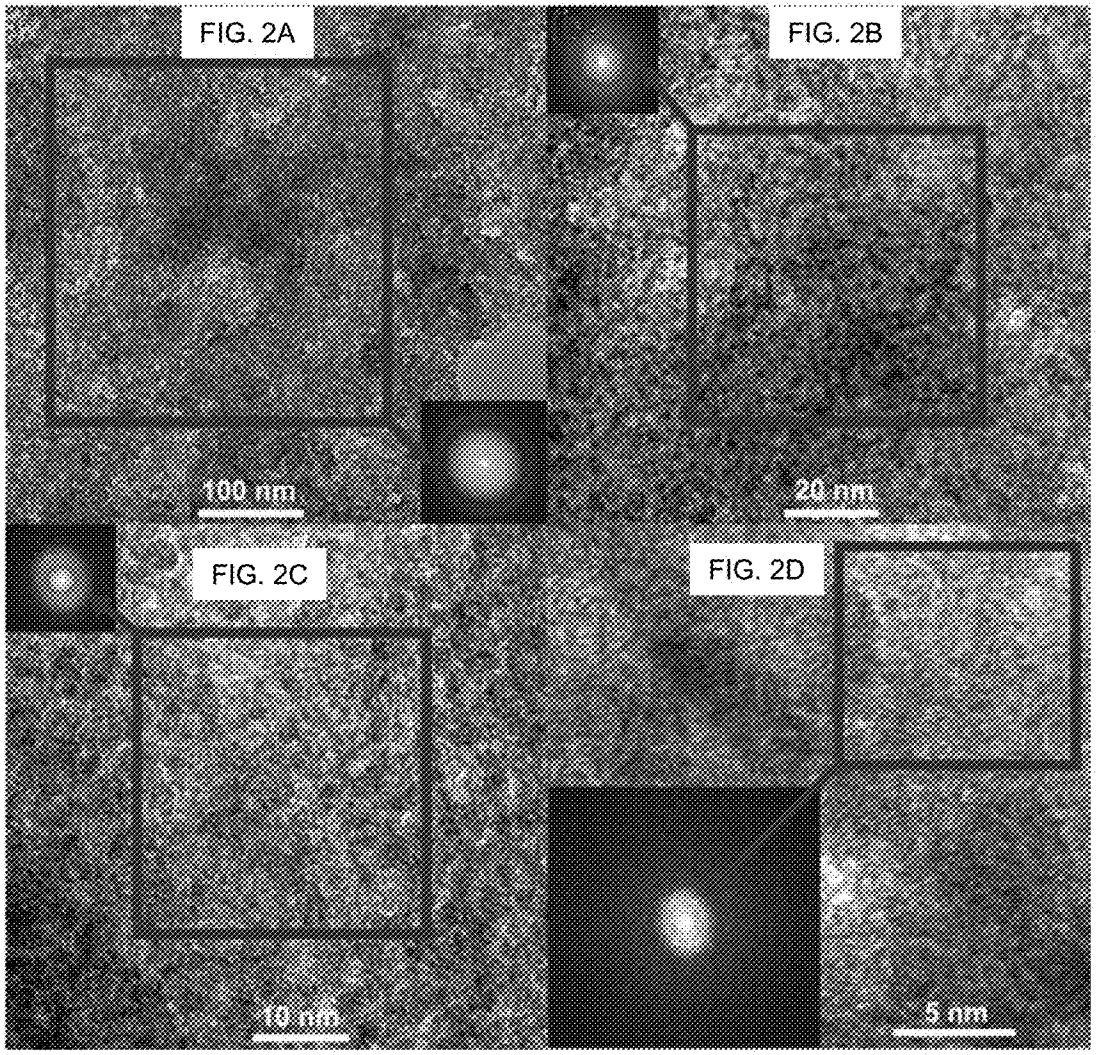
FIGS. 2A-2D show high resolution transmission electron microscopy (HRTEM) images of the microwave-assisted nanoamorphous $Ni_{0.8}$:$Fe_{0.2}$ with the corresponding electron diffractograms (inlays).

High resolution transmission electron microscopy (HR-TEM) images (FIGS. 2A-2D) show that the microwave-assisted $Ni_{0.8}$:$Fe_{0.2}$ is not a collection of individual particles (as is true of the crystal-derived structures) but, rather it is a nanoamorphous network. Complete absence of crystalline order is seen even at the 5 nanometer scale (FIG. 2D). For this reason, the term "nanoamorphous" is used to describe the microwave-assisted $Ni_{0.8}$:$Fe_{0.2}$ as the term refers to the lack of crystalline order down to a length of about 5 nm. Electron diffractograms (inlays in FIGS. 2A-2D) show no diffraction spots, indicating that the microwave-assisted $Ni_{0.8}$:$Fe_{0.2}$ is indeed nanoamorphous. XRD (FIG. 3A) on the crystal-derived $Ni_{0.8}$:$Fe_{0.2}$ oxide prior to electrochemical conditioning shows the NiO rock-salt structure in addition to $Fe_3O_4$. Segregation of iron and nickel has been previously reported on nickel-iron samples that have molar ratios very near to the 25% iron segregation limit.[33,34] XRD on the microwave-assisted structure shows an amorphous structure with no iron oxide, nickel oxide, or oxyhydroxide peaks visible, further confirming that this material is amorphous. The only diffraction peaks observed are those of $NaNO_3$ which is a remnant of the titration of $Fe(NO_3)_3$ or $Ni(NO_3)_2$ with $NaHCO_3$. The $NaNO_3$ crystals can be seen on SEM images of un-rinsed samples (data not shown).

XPS was performed on the crystal-derived $Ni_{0.8}$:$Fe_{0.2}$ oxide prior to conditioning (FIGS. 3B-3E, top spectrum), electrochemically conditioned crystal-derived $Ni_{0.8}$:$Fe_{0.2}$ oxyhydroxide (FIGS. 3B-3E, second spectrum), solution-derived (non-microwaved) $Ni_{0.8}$:$Fe_{0.2}$ (FIGS. 3B-3E, third spectrum), and microwave-assisted nanoamorphous $Ni_{0.8}$:$Fe_{0.2}$ (FIGS. 3B-3E, bottom spectrum). On the crystal-derived sample prior to conditioning, the Fe $2p_{3/2}$ binding energy was 711 eV, which is consistent with the binding energy for $Fe_3O_4$.[59] Three separate O 1S peaks are visible at binding energies of 528.8 eV, 530.0 eV, and 531.6 eV. The 528.8 eV peak is consistent with iron oxides and/or hydroxide species, and the 530 eV and 531.6 eV peaks are consistent with nickel oxide and/or hydroxide species.[30,60] The Ni $2p_{3/2}$ binding energies were 854.5 eV and 856.5 eV. The 854.5 eV peak is consistent with NiO, and the 856.5 eV peak is consistent with NiO or nickel hydroxide.[30,60] The multiple oxygen and nickel peaks confirm that some segregation occurs during the synthesis of the crystal-derived structure prior to conditioning as also shown with the XRD data. The electrochemically conditioned crystal-derived sample shows similar characteristic peaks, and the two separate O 1S peaks suggest that segregation still exists in the crystalline nickel-iron oxyhydroxide structure.

On the microwave-assisted structure, the Ni $2p_{3/2}$ binding energy was 855.9 eV, indicative of $Ni(OH)_2$ or NiOOH.[30,60] The single O 1S peak at a binding energy of 531.2 eV is indicative of nickel oxide, nickel hydroxide, or iron hydroxide species.[30,59-61] The Fe $2p_{3/2}$ binding energy of 711.1 eV is also indicative of an iron binding energy in a hydroxide structure.[61] However, the solution-derived (non-microwaved) binding energies contain a crucial difference when compared to that of the microwave-assisted. On the non-microwaved sample, there is a C is binding energy at 289.2 eV, which is not present on the microwave-assisted structure. The 289.2 eV peak is consistent with a carbonate peak,[58] which gives strong evidence to support the formation of an inactive iron carbonate species in the initial steps of the synthesis preceding the microwave step. In addition, this XPS data is further evidence that the microwave-assisted synthesis is able to create a nickel-iron structure with no measurable segregation of iron.

Electrochemical Characterization

Figure 4A:
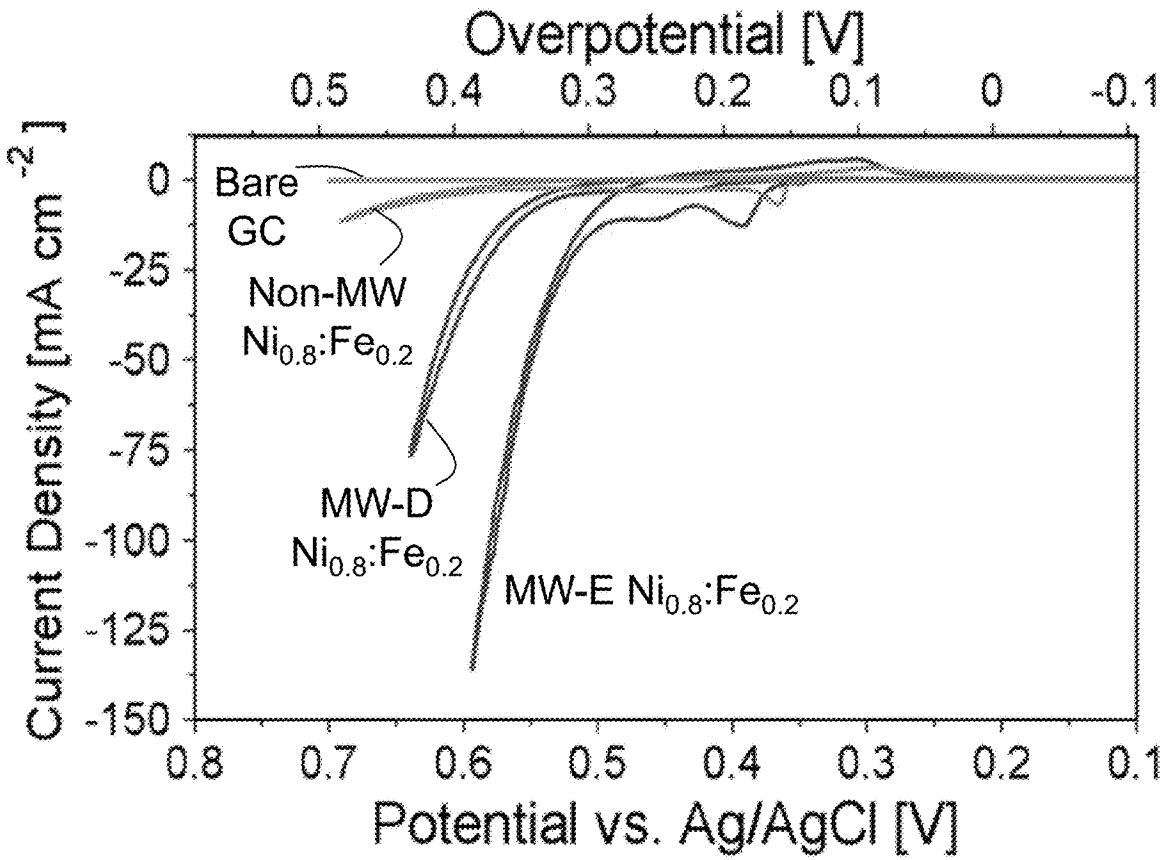
FIG. 4A shows rotating disc electrode cyclic voltammograms of microwave-assisted electrodeposited (MW-E) and dropcast (MW-D) nanoamorphous $Ni_{0.8}$:$Fe_{0.2}$, with solution-derived (Non-MW) $Ni_{0.8}$:$Fe_{0.2}$ on a glassy carbon (GC) electrode at 10 mV $s^{-1}$.

Rotating disc electrode (RDE) cyclic voltammograms of solution-derived (non-microwaved) and microwave-assisted $Ni_{0.8}$:$Fe_{0.2}$ on a glassy carbon electrode, along with bare glassy carbon are shown in FIG. 4A. Here the utility of the microwaving step is apparent. The activity of the non-microwaved (i.e. carbonate) material over the bare glassy carbon is marginal. However, the catalytic activity of microwave-assisted structure shows a dramatic improvement compared to the non-microwaved structure. Two deposition techniques were also utilized to apply the microwave-assisted sample to the GC electrode, electrophoretic deposition and dropcasting (MW-E and MW-D, respectively). It was found that electrophoretic deposition (electrodeposition) provided better catalyst coverage and higher catalytic activity, with the MW-E electrode reaching 100 mA $cm^{-2}$ at 369 mV overpotential.

Figure 4B:
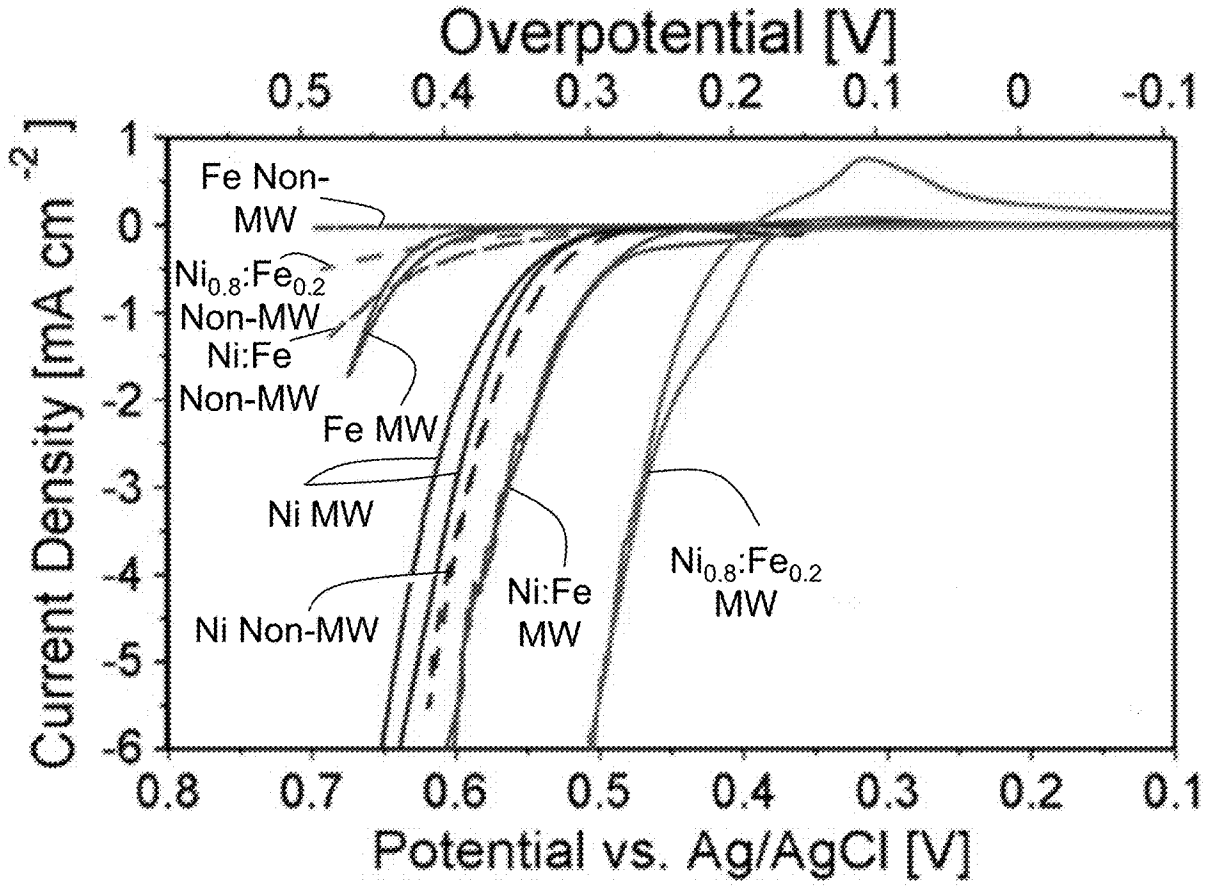
FIG. 4B shows static cyclic voltammograms of solution-derived (non-microwaved) and microwave-assisted $Ni_{1-x}$:$Fe_x$ on FTO glass at 1 mV $s^{-1}$.

To further demonstrate the utility of the microwave-step, the catalytic activity of non-microwaved and microwave-assisted structures of mixed-metal $Ni_{1-x}$:$Fe_x$ with different Ni:Fe ratios (representative cyclic voltammograms are shown in FIG. 4B) were compared. It was observed that the non-microwaved samples containing Fe (Fe, Ni:Fe, and $Ni_{0.8}$:$Fe_{0.2}$) did not have any significant catalytic activity for the OER, nor did were the $Ni(OH)_2$/NiOOH redox peaks typically found in Ni:Fe oxyhydroxides[22,23] observed for these samples (data not shown). For all of the $Ni_{1-x}$:$Fe_x$ microwave-assisted structures, the $Ni(OH)_2$/NiOOH redox peaks were observed (data not shown) and a large oxidation current indicative of catalytic activity for the OER. The solution-derived and microwave-assisted samples that only contained Ni also exhibited both of these characteristics. Since no attempt was made to purify the Ni precursors, the relatively high activity of the Ni-only samples is attributed to Fe impurities that may be present.[10,23] Triplicate cyclic voltammetry measurements from different synthesis batches show good reproducibility for all microwave-assisted structures (data not shown).

Figure 4C:
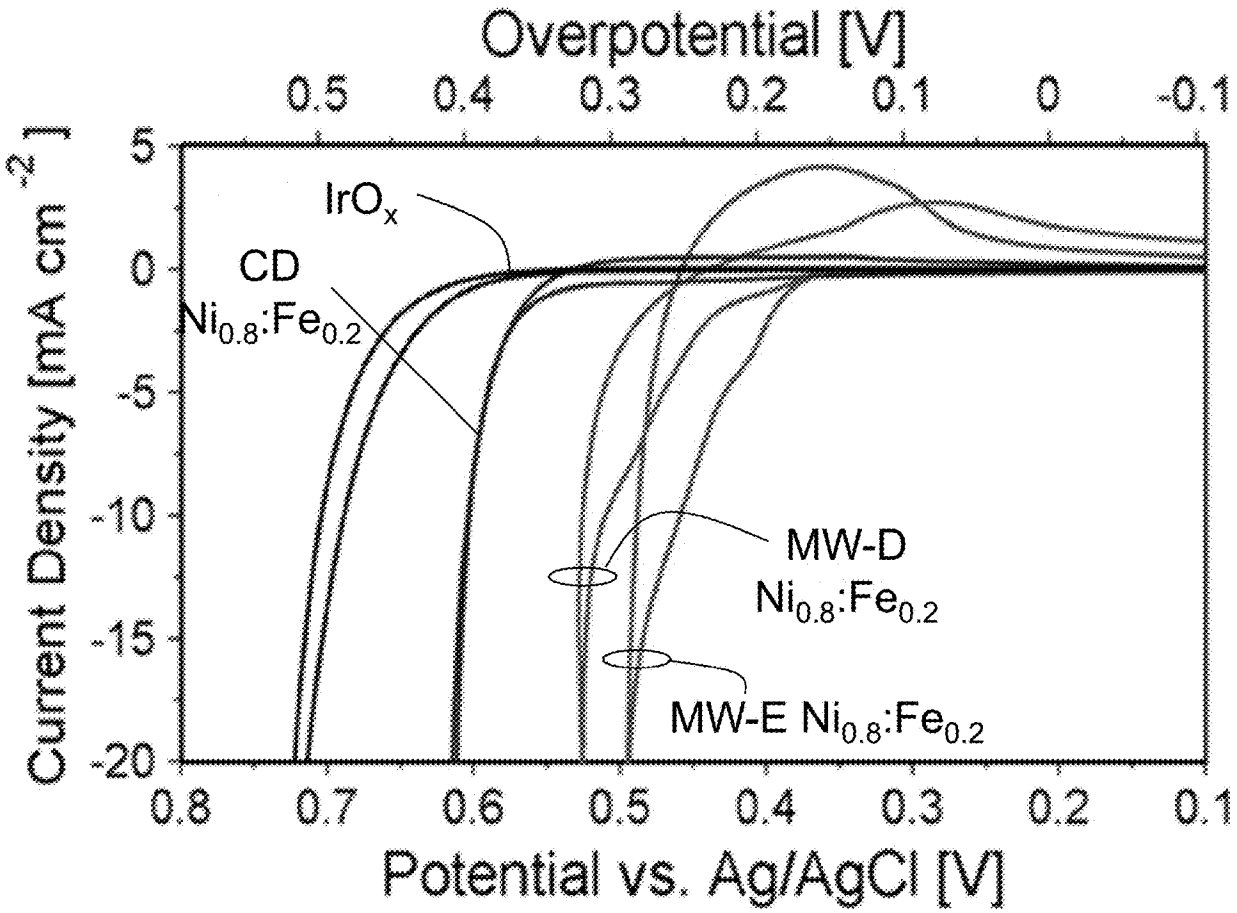
FIG. 4C shows static cyclic voltammograms of MW-E and MW-D nanoamorphous $Ni_{0.8}$:$Fe_{0.2}$ along with crystal-derived (CD) $Ni_{0.8}$:$Fe_{0.2}$ oxyhydroxide and crystalline $IrO_x$ on FTO glass at 50 mV $s^{-1}$. All experiments were performed in 1 M NaOH and are corrected for uncompensated resistance ($R_u$).

To compare the MW-E and MW-D $Ni_{0.8}$:$Fe_{0.2}$ to the crystal-derived $Ni_{0.8}$:$Fe_{0.2}$ oxyhydroxide and crystalline $IrO_x$, cyclic voltammograms were performed with all samples deposited onto FTO-coated glass (FIG. 4C). Both the microwave-assisted and crystal-derived samples show the $Ni(OH)_2$/NiOOH redox peaks and the large oxidation current indicative of catalytic activity for the OER. The $IrO_x$ sample also shows a small wave, which may be attributed to a $Ir^{IV}/Ir^{V}$ transition,[37] prior to the onset of the large oxidation wave indicative of catalytic activity for the OER. The static cyclic voltammetry measurements showed that MW-E $Ni_{0.8}$:$Fe_{0.2}$ electrode has an overpotential ca. 100 mV less than that of the crystal-derived $Ni_{0.8}$:$Fe_{0.2}$ and ca. 200 mV less than that of crystalline $IrO_x$.

In order to determine if the increase in catalytic activity of the microwave-assisted electrodeposited $Ni_{0.8}$:$Fe_{0.2}$ samples was due to an increase in the electrochemical surface area (ECSA), the double layer capacitance was measured via cyclic voltammetry (data not shown). Similar and very low roughness factors were measured on both the crystalline $Ni_{0.8}Fe_{0.2}$OOH and the microwave-assisted nanoamorphous $Ni_{0.8}$:$Fe_{0.2}$ structures, 1.2 and 1.4, respectively. In addition, a slightly higher mass loading was observed for the crystal-derived sample (120±20 μg $cm^{-2}$) as compared to the microwave-assisted sample (60±20 μg $cm^{-2}$). These results suggest that the increased electrocatalytic activity of the microwave-assisted structure is not simply due to an increase in the ECSA or an increase in the mass loading.

Figure 5:
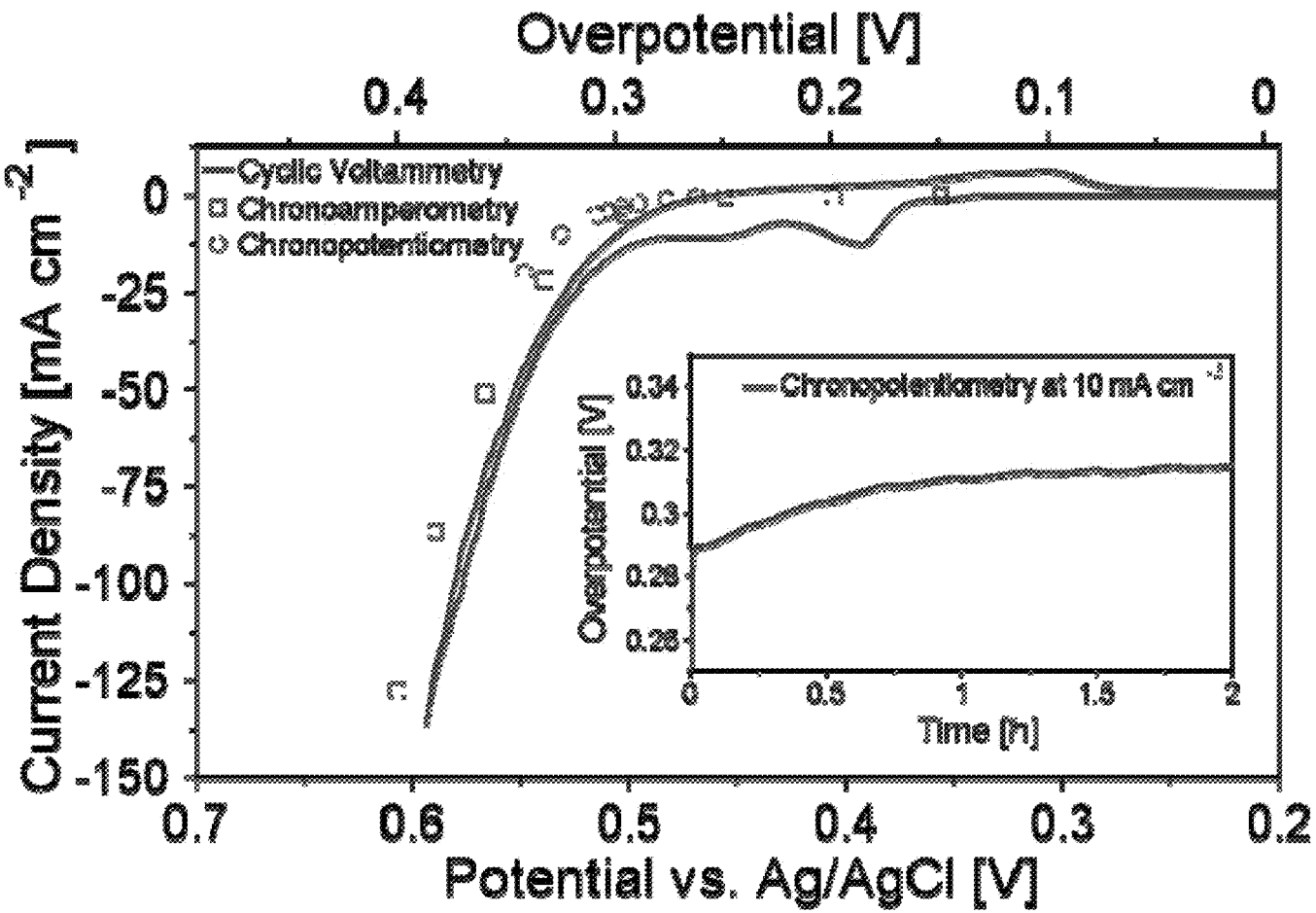
FIG. 5 shows cyclic voltammogram at 10 mV $s^{-1}$ (solid line), steady-state potentials from 30 s chronoamperometry experiments (squares), and steady-state currents from 30 s chronopotentiometry experiments (circles) on microwave-assisted nanoamorphous $Ni_{0.8}$:$Fe_{0.2}$ electrodeposited on a glassy carbon rotating disc electrode (RDE). The inlay shows the 2 h chronopotentiometry experiment at 10 mA $cm^{-2}$ with the microwave-assisted nanoamorphous $Ni_{0.8}$:$Fe_{0.2}$ electrodeposited on a glassy carbon RDE. All RDE experiments were operated at 1600 rpm in 1 M NaOH and corrected for $R_u$.

While the microwave-assisted $Ni_{0.8}$:$Fe_{0.2}$ sample showed an OER overpotential of 250 mV at 10 mA $cm^{-2}$, overpotentials obtained from FIG. 4C are not at steady-state. This makes comparison difficult due to transient concentration gradients that occur in static cyclic voltammetry experiments. Thus, the overpotential was obtained under steady-state conditions to benchmark the electrocatalytic activity for the OER as articulated by Jaramillo (FIG. 5).[5] The steady-state currents from 30 s chronoamperometry experiments (squares) and the steady-state overpotentials from 30 s chronopotentiometry experiments (circles) agree well with the RDE cyclic voltammetry curve (solid line). The microwave-assisted nanoamorphous electrodeposited $Ni_{0.8}$:$Fe_{0.2}$ sample had a low overpotential for the OER at 286 mV for 10 mA $cm^{-2}$ (geometric area), where the overpotential at t=0 was taken from the chronopentiometry curve at 30 s. This value is among the lowest overpotentials reported on "flat" electrodes. (See C. C. McCrory, et al., *J. Am. Chem. Soc.,* 2013, 135, 16977-16987; L. Trotochaud, et al., *J. Am. Chem. Soc.,* 2012, 134, 17253-17261; M. W. Louie, et al., *J. Am. Chem. Soc.,* 2013, 135, 12329-12337; X. Long, et al., *Angew. Chem.,* 2014, 126, 7714-7718; T. T. Hoang, et al., *ACS Catal.,* 2016, 6, 1159-1164; M. Görlin, et al., *Catal. Today,* 2016, 262, 65-73; A. S. Batchellor, et al., *ACS Catal.,* 2015, 5, 6680-6689; and B. M. Hunter, et al., *J. Am. Chem. Soc.,* 2014, 136, 13118-13121.) A 2 hour chronopotentiometry experiment at 10 mA $cm^{-2}$ was also conducted to assess the stability of the catalyst. After two hours of applying an overpotential sufficient to produce a current density of 10 mA $cm^{-2}$, the required overpotential increased only slightly to 315 mV (FIG. 5, inlay).

Surface-Interrogation Scanning Electrochemical Microscopy

In order to determine if the reason for the increased activity of the microwave-assisted, nanoamorphous ($Ni_{0.8}$:$Fe_{0.2}$) structure was due to an increased percentage of "fast" catalytic sites, surface interrogation scanning electrochemical microscopy (SI-SECM) was performed on both the nanoamorphous and crystalline samples. Traditionally, SI-SECM involves two ultramicroelectrodes (UMEs) of the same size aligned such that analyte produced from one of the electrodes (tip or substrate) is quantified via electrochemical detection without the analyte ever escaping the tip/substrate gap.[38] The standard use of size-matched UMEs requires that one of the UME surfaces be composed of the electrocatalytic material to be analyzed. Justification of this technique is difficult if the preliminary studies (i.e. cyclic voltammetry) of the catalytic material are better suited on conductive supports (i.e. FTO-coated glass), which are not easily created as UME surfaces. To circumvent this problem, a masking technique was introduced to create pseudo-UME surfaces from large (a >500 μm) substrates. A 12.5 μm thick Teflon fluorinated ethylene propylene (FEP) film with a voided center ([effective] radius a=31 and 37 μm for crystal-derived $Ni_{0.8}$:$Fe_{0.2}$ and microwave-assisted $Ni_{0.8}$:$Fe_{0.2}$ samples, respectively) was heat-bonded to the electrodes to yield a pseudo-UME substrate suitable to perform SI-SECM. A glassy carbon UME (radius a=29 μm) was crafted similar in procedure to that described elsewhere.[37] The redox mediator employed for the SI-SECM titration was an iron(III)-triethanolamine (Fe(III)-TEA) complex ($E^{o}$=−1.05 V vs Ag/AgCl in 2 M NaOH).[34,37]

Figure 8:
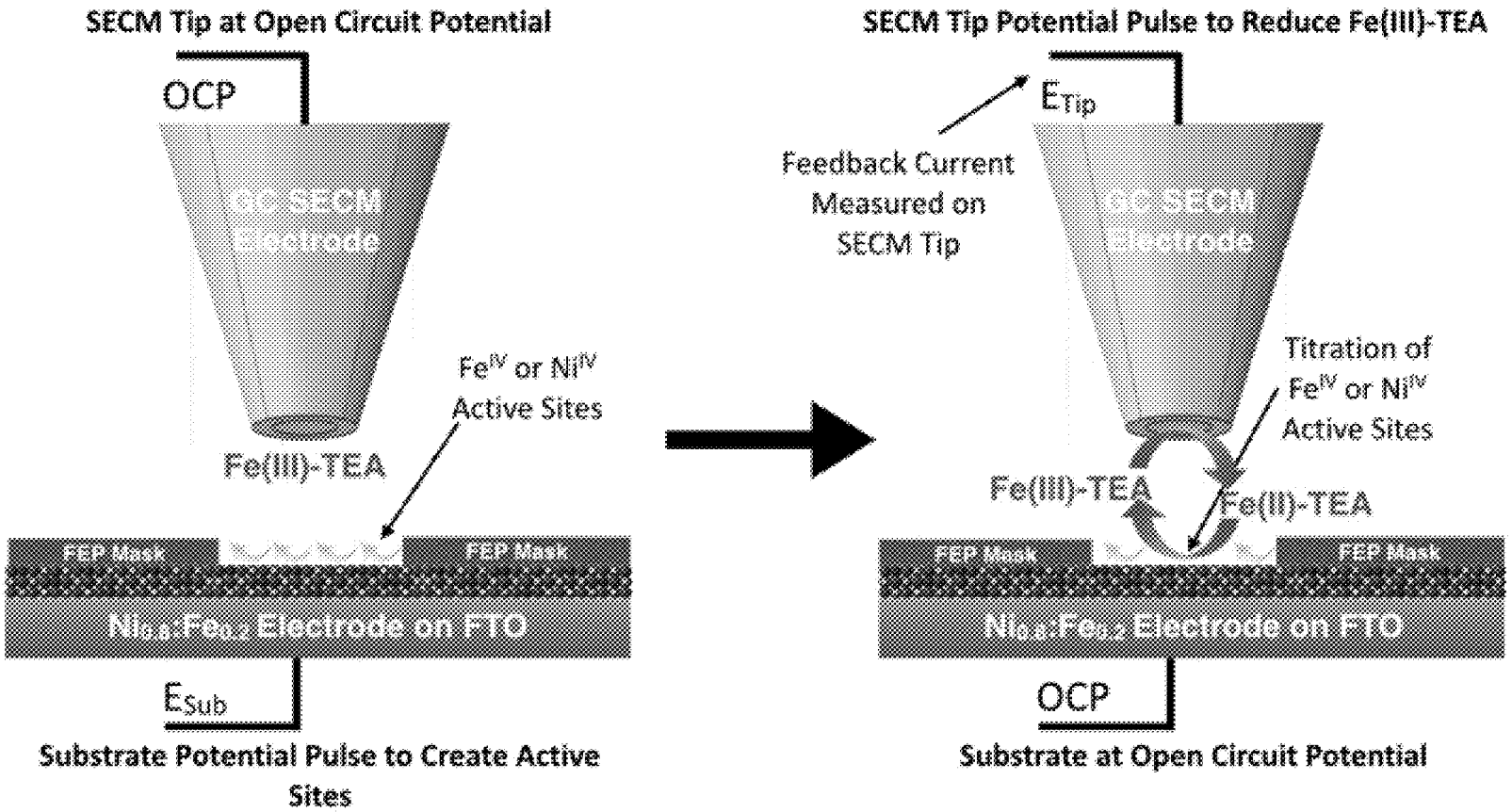
FIG. 8 illustrates the SI-SECM experimental sequence. First (left) a potential pulse is applied to the catalytic substrate to create active sites. Second (right) a potential pulse is applied to the SECM tip (while the catalytic substrate is at open-circuit) to generate reactive Fe(II)-TEA which titrates the active sites on the catalytic substrate.

To conduct the SI-SECM experiment, the tip was aligned with the substrate and approached to a tip/substrate gap of ca. 7 μm above the FEP mask. The surface interrogation mode involved two steps (FIG. 8). A potential pulse, $E_{sub}$ (0.383 V overpotential) was first applied to the substrate to generate surface-active $Ni^{IV}$ and/or $Fe^{IV}$ species,[34] while the tip was held at a potential near open circuit potential (OCP) for a characteristic time, $t_{step}$ (20 s). Subsequently, the substrate electrode was switched to OCP, and after a delay time, $t_{delay}$(varied from 0 to 2000 ms), the potential of the tip was stepped to $E_{tip}$ (−1.1 V vs Ag/AgCl) to introduce the titrant, Fe(II)-TEA (Equation 4).

$$\text{Fe(III)-TEA}+e^{-}\rightarrow\text{Fe(II)-TEA} \quad \text{(Equation 4)}$$

$$\text{Fe(II)-TEA}+\text{S}^{*}\rightarrow\text{Fe(III)-TEA}+\text{S} \quad \text{(Equation 5)}$$

When the $Ni^{III}$, $Ni^{IV}$ and/or $Fe^{IV}$ surface-active species (S*) are present, the titration of the surface species back to $Ni^{II}$ and/or $Fe^{III}$ produces positive feedback current on the tip until all surface-active species on the substrate are consumed (Equation 5).[34] In this experiment, when the substrate was switched to OCP these surface species participated solely in water oxidation until the potential of the tip was stepped to $E_{tip}$ after $t_{delay}$ (Equations 6 and 7). By titrating the surface species remaining after different delay times, concentration-time profiles were obtained, allowing for the extraction of the pseudo-first order rate constant of water oxidation by the catalytic sites of the substrate.

To obtain the concentration profiles (data not shown) from the current-time data, the surface charge densities at each $t_{delay}$ were first quantified by integrating the net current (difference of measured current and negative feedback current).[34] The SI-SECM negative feedback trace (data not shown) was simulated via finite element analysis in COMSOL Multiphysics (details provided above).

$$Fe^{IV}+H_2O \xrightarrow{e^-} Fe^{III}+OH_{(ads)}.+H^+ \quad \text{(Equation 6)}$$

$$Ni^{IV}+H_2O \xrightarrow{e^-} Ni^{III}+OH_{(ads)}.+H^+ \quad \text{(Equation 7)}$$

Figure 6A:
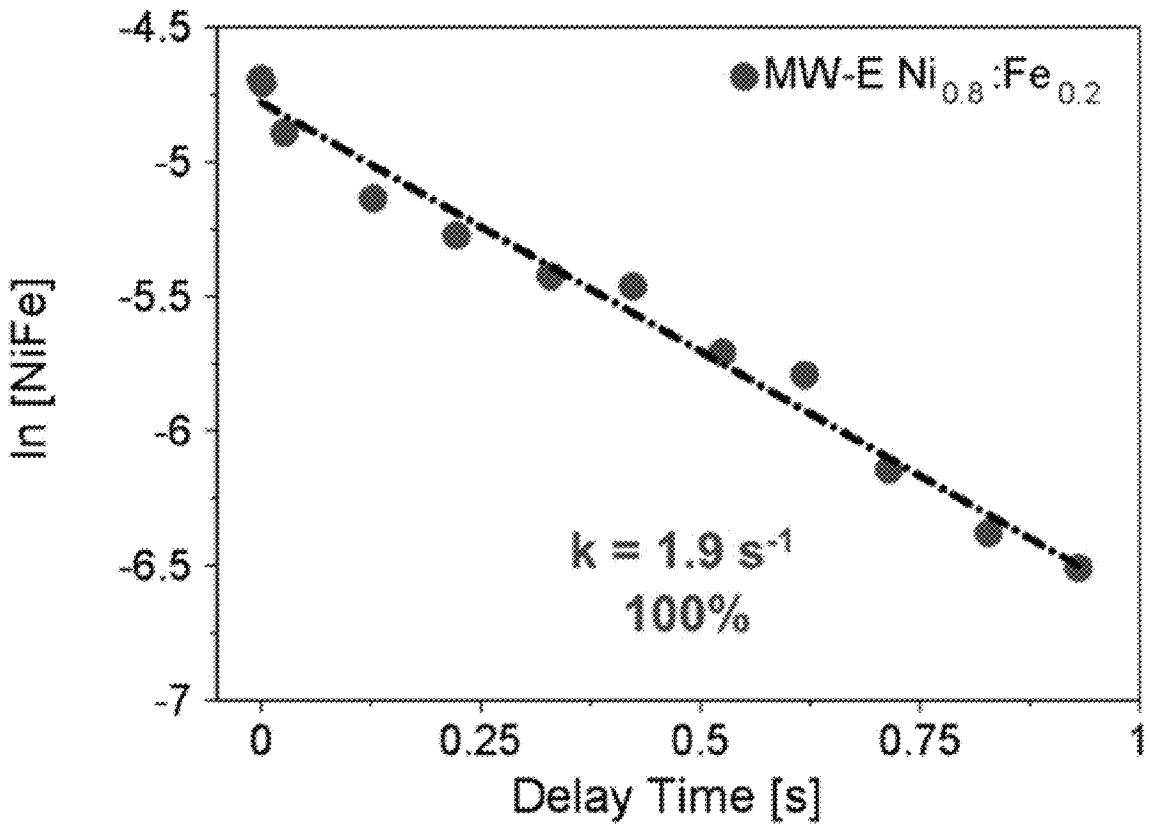
FIGS. 6A-6C show the measured pseudo-first order rate constants of the OER on the activated sites of the microwave-assisted nanoamorphous $Ni_{0.8}$:$Fe_{0.2}$ (FIG. 6A) and electrochemically conditioned crystal-derived $Ni_{0.8}$:$Fe_{0.2}$ oxyhydroxide (FIGS. 6B, 6C).
Figure 6C:
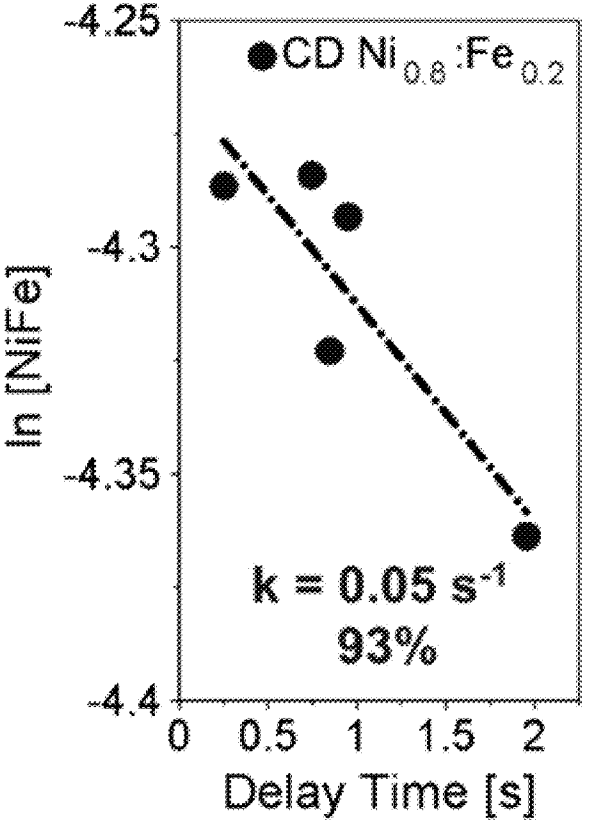
Figure 6B:
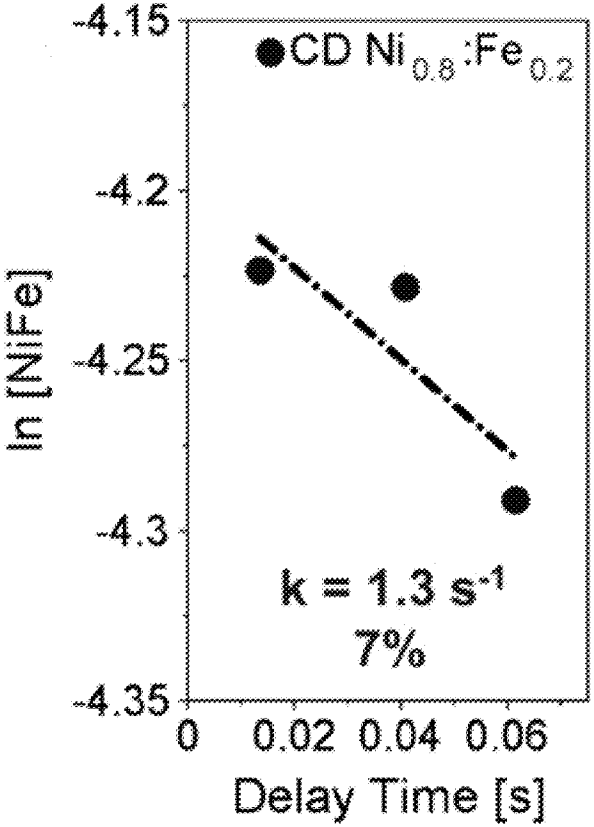

The resulting concentration-time profiles (FIGS. 6A-6C) were used to extract the pseudo-first order rate constant(s) of each material. The crystal-derived $Ni_{0.8}$:$Fe_{0.2}$ oxyhydroxide showed a sharp decrease in the number of active sites at very short delay times (less than 0.1 s), followed by a gradual decrease in the number of active sites at long delay times (greater than 0.1 s). This is indicative of the existence of two types of catalytic sites as previously demonstrated by Bard and co-workers.[34] The "fast" and "slow" sites on the crystal-derived $Ni_{0.8}$:$Fe_{0.2}$ oxyhydroxide had rate constants of 1.3 $s^{-1}$ and 0.05 $s^{-1}$, respectively, which is in very good agreement with the Bard study which measured 1.70 $s^{-1}$ and 0.056 $s^{-1}$, respectively. However, the microwave-assisted nanoamorphous $Ni_{0.8}$:$Fe_{0.2}$ structure only showed a sharp decrease in the number of active sites at all times indicative of only one type of catalytic site. A kinetic rate of 1.9 $s^{-1}$ was measured indicating that the microwave-assisted nanoamorphous $Ni_{0.8}$:$Fe_{0.2}$ structure has only "fast" sites. The total active site density of the crystal-derived $Ni_{0.8}$:$Fe_{0.2}$ oxyhydroxide and microwave-assisted nanoamorphous $Ni_{0.8}$:$Fe_{0.2}$ was calculated to be 145 mC $cm^{-2}$ and 81 mC $cm^{-2}$, respectively, using the y-intercept of the concentration-time regression lines. The microwave-assisted sample had 100% fast sites while the crystal-derived sample had only 7% fast sites and 93% slow sites, roughly correlating to the ratio of Fe to Ni in the sample. This matched well with the total iron atom content (20%), and the lower percentage of fast sites can be attributed to the segregation that was observed in the XRD and XPS measurements for the crystalline oxyhydroxide structure.

Conclusions

This Example reports a microwave-assisted synthesis method to create mixed-metal nanoamorphous nickel-iron catalysts for the OER. It was observed that on flat electrodes (roughness factor <1.4), the OER electrocatalytic activity was higher on the microwave-assisted, nanoamorphous $Ni_{0.8}$:$Fe_{0.2}$ structure compared to the crystal-derived $Ni_{0.8}$:$Fe_{0.2}$ oxyhydroxide. By benchmarking the microwave-assisted, nanoamorphous structure, it was determined that it had a very low overpotential of 286 mV at 10 mA $cm^{-2}$. The kinetics of the active sites of both the crystal-derived and microwave-assisted $Ni_{0.8}$:$Fe_{0.2}$ samples was measured directly using the surface interrogation mode of scanning electrochemical microscopy (SI-SECM). It was determined that the microwave-assisted structure contained all "fast" sites with rate constant 1.9 $s^{-1}$, and the crystal-derived structure contained 7% "fast" sites with rate constant 1.3 $s^{-1}$ and 93% slow sites with a rate constant of 0.05 $s^{-1}$. This finding shows that the amorphous structure provides highly efficient Ni—Fe catalysts for electrochemical water oxidation.

Example 2

Figure 12A:
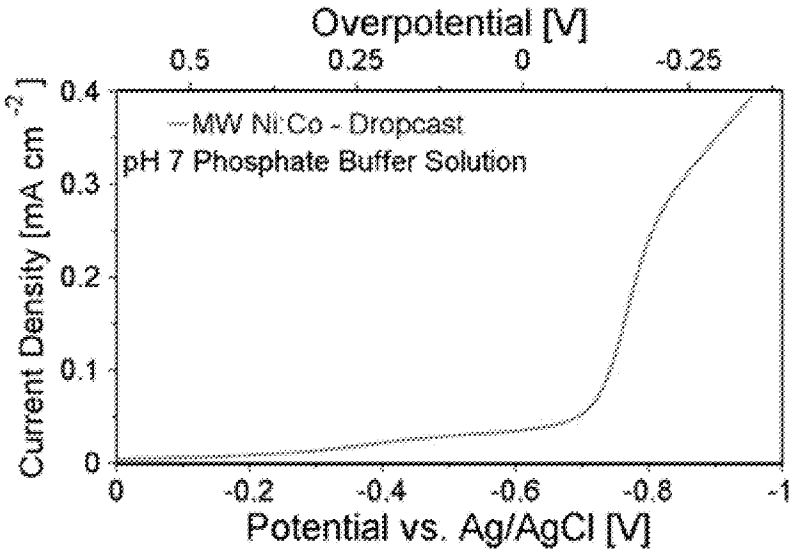
FIGS. 12A, 12C and 12D show static cyclic voltammograms in 0.1 M phosphate buffer solution (PBS) of microwave-assisted (MW) Ni:Co (FIG. 12A) and MW $Ni_{0.8}$:$Fe_{0.2}$ (FIG. 12C) dropcast on FTO, as well as, MW $Ni_{0.8}$:$Fe_{0.2}$ (FIG. 12D) electrophoretically deposited (electrodeposited) on FTO glass.
Figure 12B:
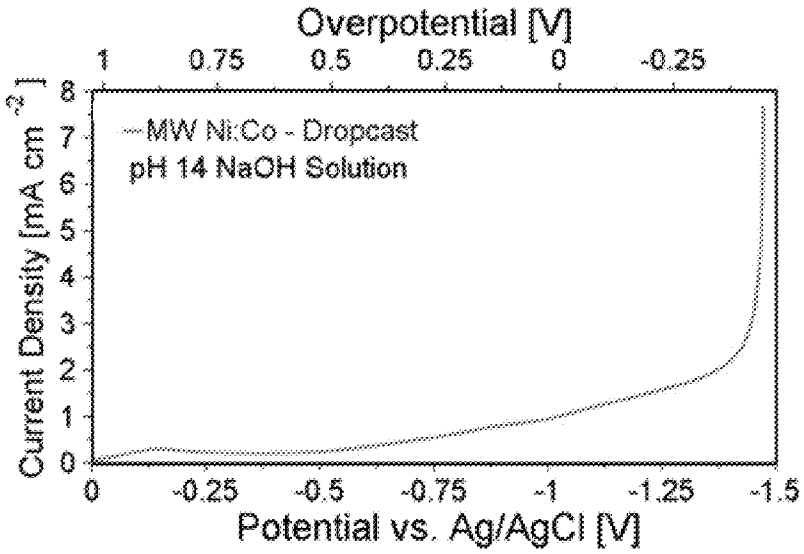
FIG. 12B shows static cyclic voltammogram in 1 M NaOH of MW Ni:Co dropcast on FTO glass. All cyclic voltammograms were taken at 50 mV $s^{-1}$ and corrected for uncompensated resistance, $R_u$. Overpotentials were reported with respect to the hydrogen evolution reaction (HER) in pH 7 for FIGS. 12A, 12C and 12D and pH 14 for FIG. 12B, respectively.
Figure 12C:
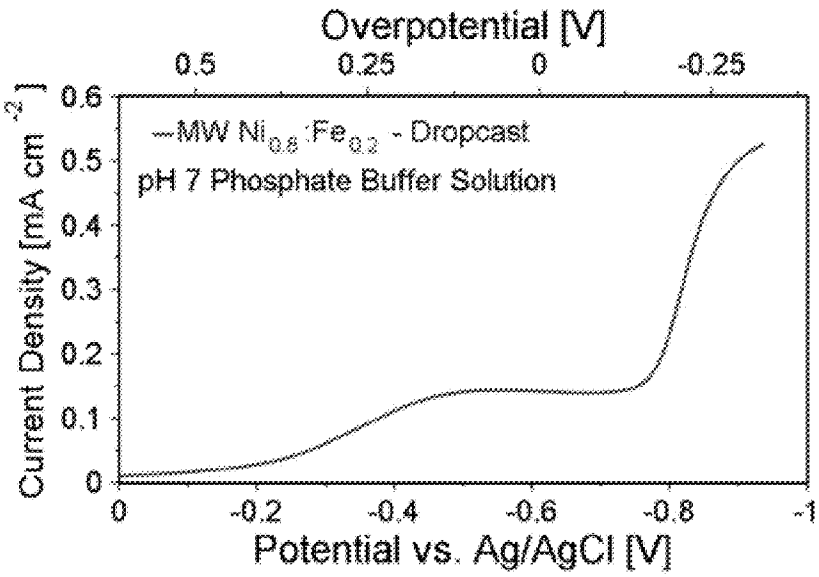
Figure 12D:
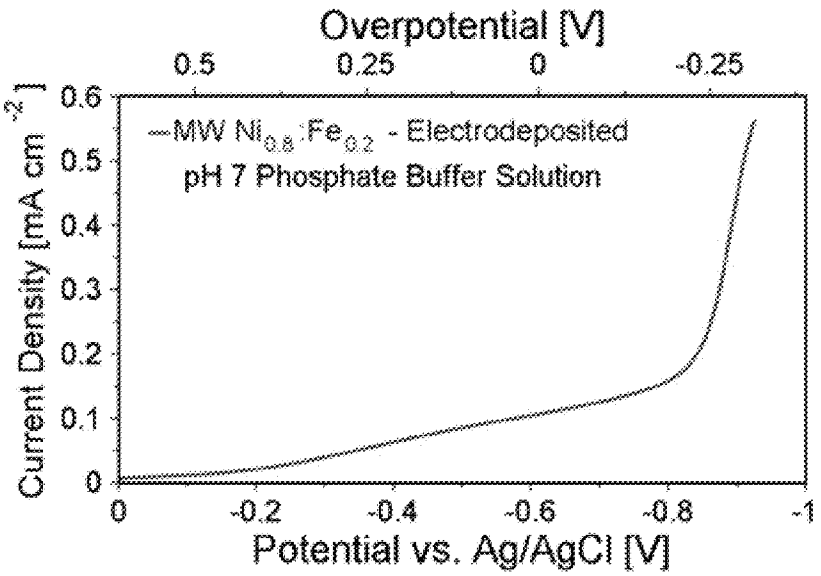

Additional mixed-metal oxyhydroxide electrocatalytic materials were prepared according to the synthesis described in the "Nanoamorphous Microwave-Assisted Catalysts" section of Example 1, above. For Co containing materials, cobalt(II) nitrate [$Co(NO_3).6H_2O$] was used. For W containing materials ammonium metatungstate hydrate was used. In all cases, the solvent was water, the gelling agent was $NaHCO_3$ and all other conditions were as described in Example 1, above. The materials included microwave-assisted W:Fe:Co, Ni:Fe:Co, and Ni:Co. Microwave-assisted Co, microwave-assisted $Ni_{0.8}$:$Fe_{0.2}$, crystal-derived Co, and crystalline $IrO_x$ were prepared as described in Example 1, above, for comparison. Illustrative electrochemical results are shown in FIGS. 10A-10J (using neutral pH), FIGS. 11A-11F (using alkaline pH), FIGS. 12A, 12C, 12D (using neutral pH) and FIG. 12B (using alkaline pH).

REFERENCES

1 A. J. Bard and M. A. Fox, *Acc. Chem. Res.,* 1995, 28, 141-145.
2 H. B. Gray *Nat. Chem.,* 2009, 1, 7-7.
3 M. W. Kanan and D. G. Nocera, *Science,* 2008, 321, 1072-1075.
4 I. C. Man, H. Y. Su, F. Calle-Vallejo, H. A. Hansen, J. I. Martínez, N. G. Inoglu, J. Kitchin, T. F. Jaramillo, J. K. Nørskov and J. Rossmeisl, *ChemCatChem,* 2011, 3, 1159-1165.
5 C. C. McCrory, S. Jung, I. M. Ferrer, S. M. Chatman, J. C. Peters and T. F. Jaramillo, *J. Am. Chem. Soc.,* 2015, 137, 4347-4357.
6 S. Trasatti, *Electrochim. Acta,* 1984, 29, 1503-1512.
7 H. Dau, C. Limberg, T. Reier, M. Risch, S. Roggan and P. Strasser, *ChemCatChem,* 2010, 2, 724-761.
8 J. Horkans and M. Shafer, *J. Electrochem. Soc.,* 1977, 124, 1202-1207.
9 D. A. Corrigan, *J. Electrochem. Soc.,* 1987, 134, 377-384.
10 L. Trotochaud, S. L. Young, J. K. Ranney and S. W. Boettcher, *J. Am. Chem. Soc.,* 2014, 136, 6744-6753.
11 J. A. Bau, E. J. Luber and J. M. Buriak, *ACS Appl. Mater. Interfaces,* 2015, 7, 19755-19763.
12 E. Guerrini, M. Piozzini, A. Castelli, A. Colombo and S. Trasatti, *J. Solid State Electrochem.,* 2008, 12, 363-373.
13 J. Landon, E. Demeter, N. İnoğlu, C. Keturakis, I. E. Wachs, R. Vasić, A. I. Frenkel and J. R. Kitchin, *ACS Catal.,* 2012, 2, 1793-1801.
14 J. R. Swierk, S. Klaus, L. Trotochaud, A. T. Bell and T. D. Tilley, *J. Phys. Chem. C,* 2015, 119, 19022-19029.
15 X. Zhang, H. Xu, X. Li, Y. Li, T. Yang and Y. Liang, *ACS Catal.,* 2015, 6, 580-588.
16 T. T. Hoang and A. A. Gewirth, *ACS Catal.,* 2015, 6, 1159-1164.
17 Y. Hou, M. R. Lohe, J. Zhang, S. Liu, X. Zhuang and X. Feng, *Energy Environ. Sci.,* 2016, 9, 478-483.
18 T. W. Kim and K.-S. Choi, *Science,* 2014, 343, 990-994.
19 X. Lu and C. Zhao, *Nat. Commun.,* 2015, 6.

20 Y. Hou, Z. Wen, S. Cui, X. Feng and J. Chen, *Nano Lett.,* 2016, 16, 2268-2277.

21 M. S. Burke, S. Zou, L. J. Enman, J. E. Kellon, C. A. Gabor, E. Pledger and S. W. Boettcher, *J. Phys. Chem. Lett.,* 2015, 6, 3737-3742.

22 M. W. Louie and A. T. Bell, *J. Am. Chem. Soc.,* 2013, 135, 12329-12337.

23 S. Klaus, Y. Cai, M. W. Louie, L. Trotochaud and A. T. Bell, *J. Phys. Chem. C,* 2015, 119, 7243-7254.

24 B. M. Hunter, J. D. Blakemore, M. Deimund, H. B. Gray, J. R. Winkler and A. M. Müller, *J. Am. Chem. Soc.,* 2014, 136, 13118-13121.

25 L. Trotochaud, J. K. Ranney, K. N. Williams and S. W. Boettcher, *J. Am. Chem. Soc.,* 2012, 134, 17253-17261.

26 M. Gong, Y. Li, H. Wang, Y. Liang, J. Z. Wu, J. Zhou, J. Wang, T. Regier, F. Wei and H. Dai, *J. Am. Chem. Soc.,* 2013, 135, 8452-8455.

27 X. Yu, M. Zhang, W. Yuan and G. Shi, *J. Mater. Chem. A,* 2015, 3, 6921-6928.

28 X. Long, J. Li, S. Xiao, K. Yan, Z. Wang, H. Chen and S. Yang, *Angew. Chem.,* 2014, 126, 7714-7718.

29 Z. Lu, W. Xu, W. Zhu, Q. Yang, X. Lei, J. Liu, Y. Li, X. Sun and X. Duan, *Chem. Commun.,* 2014, 50, 6479-6482.

30 B. M. Hunter, W. Hieringer, J. Winkler, H. B. Gray and A. M. Miller, *Energy Environ. Sci.,* 2016, 9, 1734-1743.

31 R. D. Smith, M. S. Prévot, R. D. Fagan, S. Trudel and C. P. Berlinguette, *J. Am. Chem. Soc.,* 2013, 135, 11580-11586.

32 T. D. McDonald, C. Bayer, A. M. DeLee, E. Atchison, D. Widrig, B. Hutchens and K. C. Leonard, *J. Electrochem. Soc.,* 2016, 163, H359-H366.

33 D. Friebel, M. W. Louie, M. Bajdich, K. E. Sanwald, Y. Cai, A. M. Wise, M. J. Cheng, D. Sokaras, T. C. Weng, R. Alonso-Mori, R. C. Davis, J. R. Bargar, J. K. Norskov, A. Nilsson and A. T. Bell, *J. Am. Chem. Soc.* 2015, 137, 1305-1313.

34 H. S. Ahn and A. J. Bard, *J. Am. Chem. Soc.,* 2015, 138, 313-318.

35 H. S. Park, K. C. Leonard and A. J. Bard, *J. Phys. Chem. C,* 2013, 117, 12093-12102.

36 H. S. Ahn and A. J. Bard, *J. Am. Chem. Soc.,* 2015, 137, 612-615.

37 N. Arroyo-Currás and A. J. Bard, *J. Phys. Chem. C,* 2015, 119, 8147-8154.

38 J. Rodríguez-López, M. A. Alpuche-Avilés and A. J. Bard, *J. Am. Chem. Soc.,* 2008, 130, 16985-16995.

39 L. Wang, J. Geng, W. Wang, C. Yuan, L. Kuai and B. Geng, *Nano Res.,* 2015, 8, 3815-3822.

40 C. G. Morales-Guio, M. T. Mayer, A. Yella, S. D. Tilley, M. Gratzel and X. Hu, *J. Am. Chem. Soc.,* 2015, 137, 9927-9936.

41 R. D. Smith, M. S. Prévot, R. D. Fagan, Z. Zhang, P. A. Sedach, M. K. J. Siu, S. Trudel, C. P. Berlinguette, *Science,* 2013, 340, 60-63.

42 R. D. Smith and C. P. Berlinguette, *J. Am. Chem. Soc.,* 2016, 138, 1561-1567.

43 A. Bergmann, E. Martinez-Moreno, D. Teschner, P. Chernev, M. Gliech, J. F. de Araújo, T. Reier, H. Dau and P. Strasser, *Nat. Commun.,* 2015, 6.

44 A. M. Ullman, C. N. Brodsky, N. Li, S.-L. Zheng and D. G. Nocera, *J. Am. Chem. Soc.,* 2016, 138, 4229-4236.

45 M. W. Kanan, Y. Surendranath and D. G. Nocera, *Chem. Soc. Rev.,* 2009, 38, 109-114.

46 W. Li, S. W. Sheehan, D. He, Y. He, X. Yao, R. L. Grimm, G. W. Brudvig and D. Wang, *Angew. Chem.,* 2015, 127, 11590-11594.

47 J. D. Blakemore, N. D. Schley, G. W. Olack, C. D. Incarvito, G. W. Brudvig and R. H. Crabtree, *Chem. Sci.,* 2011, 2, 94-98.

48 J. Masa, P. Weide, D. Peeters, I. Sinev, W. Xia, Z. Sun, C. Somsen, M. Muhler and W. Schuhmann, *Adv. Energy Mater.,* 2016, 6.

49 B. Zhang, X. L. Zheng, O. Voznyy, R. Comin, M. Bajdich, M. Garcia-Melchor, L. L. Han, J. X. Xu, M. Liu, L. R. Zheng, F. P. G. de Arquer, C. T. Dinh, F. J. Fan, M. J. Yuan, E. Yassitepe, N. Chen, T. Regier, P. F. Liu, Y. H. Li, P. De Luna, A. Janmohamed, H. L. L. Xin, H. G. Yang, A. Vojvodic and E. H. Sargent, *Science,* 2016, 352, 333-337.

50 N. Dahal, S. Garcia, J. Zhou and S. M. Humphrey, *ACS Nano,* 2012, 6, 9433-9446.

51 H. Katsuki and S. Komarneni, *J. Am. Ceram. Soc.,* 2001, 84, 2313-2317.

52 N. Kijima, M. Yoshinaga, J. Awaka and J. Akimoto, *Solid State Ionics,* 2011, 192, 293-297.

53 M. Baghbanzadeh, L. Carbone, P. D. Cozzoli and C. O. Kappe, *Angew. Chem., Int. Ed.,* 2011, 50, 11312-11359.

54 K. C. Leonard, K. M. Nam, H. C. Lee, S. H. Kang, H. S. Park and A. J. Bard, *J. Phys. Chem. C,* 2013, 117, 15901-15910.

55 M. L. Machevsky and M. A. Anderson, *Langmuir,* 1986, 2, 583-587.

56 R. Atkinson, A. Posner and J. Quirk, *J. Inorg. Nucl. Chem.,* 1968, 30, 2371-2381.

57 J. M. Barforoush, T. D. McDonald, T. A. Desai, D. Widrig, C. Bayer, M. K. Brown, L. C. Cummings and K. C. Leonard, *Electrochim. Acta,* 2016, 190, 713-719.

58 J. Heuer and J. Stubbins, *Corros Sci,* 1999, 41, 1231-1243.

59 W. Temesghen and P. Sherwood, *Anal. Bioanal. Chem.,* 2002, 373, 601-608.

60 *X-ray Photoelectron Spectroscopy Database* 20, National Institute of Standards and Technology, Gaithersburg, Md.; http://srdata.nist.gov/xps/.

61 N. McIntyre and D. Zetaruk, *Anal. Chem.,* 1977, 49, 1521-1529.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more".

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A method for making a metal oxyhydroxide electrocatalytic material, the method comprising:

(a) titrating a precursor solution with a (bi)carbonate salt, the precursor solution comprising a first metal salt and a solvent, wherein the titration induces reactions between the (bi)carbonate salt and the first metal salt to provide a first metal carbonate species in the titrated precursor solution;

(b) exposing the titrated precursor solution to microwave radiation to decompose the first metal carbonate species to form the metal oxyhydroxide electrocatalytic material and carbon dioxide; and (c) depositing the microwaved, titrated precursor solution onto a substrate to form a film of the metal oxyhydroxide electrocatalytic material on the substrate.

2. The method of claim 1, wherein the solvent is water.

3. The method of claim 1, wherein the titration is carried out at about room temperature and atmospheric pressure.

4. The method of claim 1, wherein the metal oxyhydroxide electrocatalytic material has a morphology which is a continuous matrix having irregularly shaped pores distributed throughout the matrix as determined by scanning electron microscopy;

wherein the metal oxyhydroxide electrocatalytic material is nanoamorphous as determined by high resolution transmission electron microscopy electron diffraction patterns exhibiting a lack of selected area electron diffraction spots at about a 5 nm spatial resolution;

and further wherein the metal oxyhydroxide electrocatalytic material has a homogeneous distribution of metal atoms throughout the material as exhibited by oxygen (O) 1s X-ray photoelectron spectroscopy spectra having no more than a single peak.

5. The method of claim 4, wherein the metal oxyhydroxide electrocatalytic material is a nickel-iron oxyhydroxide electrocatalytic material.

6. A method for making a metal oxyhydroxide electrocatalytic material, the method comprising:

(a) titrating a precursor solution with a (bi)carbonate salt, the precursor solution comprising a first metal salt and a solvent, wherein the titration induces reactions between the (bi)carbonate salt and the first metal salt to provide a first metal carbonate species in the titrated precursor solution; and (b) exposing the titrated precursor solution to microwave radiation to decompose the first metal carbonate species to form the metal oxyhydroxide electrocatalytic material and carbon dioxide, wherein the titration is carried out by adding the (bi) carbonate salt to the precursor solution at a rate of from about 0.5 mL/min to about 10 mL/min per 100 mL of the precursor solution for a period of time in the range of from about 15 min to about 120 min.

7. The method of claim 1, further comprising forming the precursor solution.

8. A method for making a metal oxyhydroxide electrocatalytic material, the method comprising:

(a) titrating a precursor solution with a (bi)carbonate salt, the precursor solution comprising a first metal salt and a solvent, wherein the titration induces reactions between the (bi)carbonate salt and the first metal salt to provide a first metal carbonate species in the titrated precursor solution; and (b) exposing the titrated precursor solution to microwave radiation to decompose the first metal carbonate species to form the metal oxyhydroxide electrocatalytic material and carbon dioxide, wherein the precursor solution further comprises a second metal salt wherein the titration also induces reactions between the (bi)carbonate salt and the second metal salt to provide second metal carbonate species in the titrated precursor solution and further wherein the microwave exposure also decomposes the second metal carbonate species to form a mixed metal oxyhydroxide electrocatalytic material.

9. The method of claim 8, wherein the metals of the mixed metal oxyhydroxide electrocatalytic material are selected from a group consisting of transition metals, post-transition metals and metalloids.

10. The method of claim 9, wherein the metals of the mixed metal oxyhydroxide electrocatalytic materials are selected from a group consisting of Fe, Co, Ni, W, In, Sb, Pb, and Bi.

11. The method of claim 8, wherein the mixed metal oxyhydroxide electrocatalytic material is a nickel-iron oxyhydroxide electrocatalytic material.

12. The method of claim 11, wherein the nickel-iron oxyhydroxide electrocatalytic material is $Ni_{0.8}$:$Fe_{0.2}$ oxyhydroxide.

13. A method for making a metal oxyhydroxide electrocatalytic material, the method comprising:

(a) titrating a precursor solution with a (bi)carbonate salt, the precursor solution comprising a first metal salt and a solvent, wherein the titration induces reactions between the (bi)carbonate salt and the first metal salt to provide a first metal carbonate species in the titrated precursor solution; and (b) exposing the titrated precursor solution to microwave radiation to decompose the first metal carbonate species to form the metal oxyhydroxide electrocatalytic material and carbon dioxide, wherein the metal oxyhydroxide electrocatalytic material has a morphology which is a continuous matrix having irregularly shaped pores distributed throughout the matrix as determined by scanning electron microscopy.

14. A method for making a metal oxyhydroxide electrocatalytic material, the method comprising:

(a) titrating a precursor solution with a (bi)carbonate salt, the precursor solution comprising a first metal salt and a solvent, wherein the titration induces reactions between the (bi)carbonate salt and the first metal salt to provide a first metal carbonate species in the titrated precursor solution; and (b) exposing the titrated precursor solution to microwave radiation to decompose the first metal carbonate species to form the metal oxyhydroxide electrocatalytic material and carbon dioxide, wherein the metal oxyhydroxide electrocatalytic material is nanoamorphous as determined by high resolution transmission electron microscopy electron diffraction patterns exhibiting a lack of selected area electron diffraction spots at about a 5 nm spatial resolution.

15. A method for making a metal oxyhydroxide electrocatalytic material, the method comprising:

(a) titrating a precursor solution with a (bi)carbonate salt, the precursor solution comprising a first metal salt and a solvent, wherein the titration induces reactions between the (bi)carbonate salt and the first metal salt to provide a first metal carbonate species in the titrated precursor solution; and (b) exposing the titrated precursor solution to microwave radiation to decompose the first metal carbonate species to form the metal oxyhydroxide electrocatalytic material and carbon dioxide, wherein the metal oxyhydroxide electrocatalytic material has a homogeneous distribution of metal atoms throughout the material as exhibited by oxygen (O) is X-ray photoelectron spectroscopy spectra having no more than a single peak.

* * * * *